US009422613B2

(12) United States Patent
Isobe et al.

(10) Patent No.: US 9,422,613 B2
(45) Date of Patent: Aug. 23, 2016

(54) CASE HARDENED STEEL HAVING REDUCED THERMAL TREATMENT DISTORTION

(71) Applicant: NIPPON STEEL & SUMITOMO METAL CORPORATION, Tokyo (JP)

(72) Inventors: Kohichi Isobe, Tokyo (JP); Masahiko Doe, Hokkaido (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 130 days.

(21) Appl. No.: 14/369,621

(22) PCT Filed: Oct. 29, 2012

(86) PCT No.: PCT/JP2012/077871

§ 371 (c)(1),
(2) Date: Jun. 27, 2014

(87) PCT Pub. No.: WO2013/111407

PCT Pub. Date: Aug. 1, 2013

(65) Prior Publication Data

US 2014/0373978 A1 Dec. 25, 2014

(30) Foreign Application Priority Data

Jan. 26, 2012 (JP) ..... 2012-014474

(51) Int. Cl.
*C22C 38/60* (2006.01)
*C22C 38/06* (2006.01)
(Continued)

(52) U.S. Cl.
CPC ..... *C22C 38/60* (2013.01); *C21D 1/18* (2013.01); *C21D 6/00* (2013.01); *C21D 9/32* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01);
(Continued)

(58) Field of Classification Search
CPC ..... C22C 38/60; C22C 38/06
USPC ..... 420/87
See application file for complete search history.

(56) References Cited

FOREIGN PATENT DOCUMENTS

CN 101148739 A 3/2008
CN 102312171 A 1/2012
(Continued)

OTHER PUBLICATIONS

International Search Report, issued in PCT/JP2012/077871, dated Jan. 22, 2013.
(Continued)

*Primary Examiner* — Weiping Zhu
(74) *Attorney, Agent, or Firm* — Birch, Stewart, Kolasch & Birch, LLP

(57) ABSTRACT

This case hardened steel has a composition including, in mass %: C: 0.05 to 0.45%; Si: 0.01 to 1.0%; Mn: over 0 to 2.0%; Al: 0.001 to 0.06%, N: 0.002 to 0.03%, S: over 0 to 0.1%, P: over 0 to 0.05%; and balance: Fe and inevitable impurities. Equation (1) described below and Equation (2) described below are satisfied in equiaxed zone, or Equation (3) described below is satisfied in columnar zone.

$Re=(Ae/Ao)\times 100\leq 30\%$ Equation (1)

$(Cmin, 1/Co)\geq 0.95$ Equation (2)

$(Cmin, 2/Co)\geq 0.95$ Equation (3)

14 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C21D 6/00*** | (2006.01) |
| ***C21D 1/18*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/38*** | (2006.01) |
| ***C22C 38/18*** | (2006.01) |
| ***C21D 9/32*** | (2006.01) |
| *C21D 1/06* | (2006.01) |
| *C23C 8/02* | (2006.01) |

(52) U.S. Cl.

CPC ..... *C22C38/18* (2013.01); *C22C 38/38* (2013.01); *C21D 1/06* (2013.01); *C23C 8/02* (2013.01)

(56) References Cited

FOREIGN PATENT DOCUMENTS

| | | | |
|---|---|---|---|
| JP | 58-52459 | A | 3/1983 |
| JP | 58-113316 | A | 7/1983 |
| JP | 61-210154 | A | 9/1986 |
| JP | 2-298250 | A | 12/1990 |
| JP | 5-70924 | A | 3/1993 |
| JP | 5-70925 | A | 3/1993 |
| JP | 5-148535 | A | 6/1993 |
| JP | 6-304712 | A | 11/1994 |
| JP | 8-109435 | A | 4/1996 |
| JP | 9-137266 | A | 5/1997 |
| JP | 10-147814 | A | 6/1998 |
| JP | 11-131184 | A | 5/1999 |
| JP | 2000-343191 | A | 12/2000 |
| JP | 2003-320439 | A | 11/2003 |
| JP | 2006-97066 | A | 4/2006 |

OTHER PUBLICATIONS

Chinese Office Action and Search Report dated Aug. 11, 2015, for Chinese Application No. 201280066577.1 with an English translation of the Search Report.

CASE HARDENED STEEL HAVING REDUCED THERMAL TREATMENT DISTORTION

TECHNICAL FIELD

The present invention relates to a case hardened steel having a surface layer portion hardened through quenching processes using carburizing, carbonitriding, or carburizing nitriding (hereinafter, also referred to as carburizing and nitriding). This case hardened steel is useful for using as a material for components, especially mechanical ones such as gears, shafts, and constant velocity universal joints in automobiles for which a high level of wear resistance or fatigue resistance is required.

The present application claims priority based on Japanese Patent Application No. 2012-014474 filed in Japan on Jan. 26, 2012, the disclosures of which are incorporated herein by reference in their entirety.

BACKGROUND ART

In recent years, from the viewpoint of reducing $CO_2$ emissions as well as further advancing energy conservation, there has been demand for transportation devices including automobiles and motorcycles having a vehicle body with reduced weights, thereby reducing the energy consumption. As part of the weigh reduction of the vehicle body, the size or weight of mechanical components such as gears and shafts has been reduced. This leads to the fact that these mechanical components are required to have improved wear resistance or fatigue resistance.

Conventionally, the wear resistance or fatigue resistance of these mechanical components such as gears has been usually improved by applying case-hardening processes typified by quenching processes using carburizing and nitriding. However, in the case of mechanical components which have case-hardened processes applied thereto with the aim of achieving improved smoothness and quietness thereof during operation, in order to respond to technical demands for improvements in the accuracy of the dimensions of these mechanical components, it is extremely important to reduce distortion occurring during the case-hardening processes (hereinafter, also referred to as thermal treatment distortion) as much as possible.

As for a measure for reducing the thermal treatment distortion, Patent Documents 1 and 2 disclose the example of a method of adjusting internal structures so as to have an austenite+ferrite layer after a thermal treatment using carburizing and nitriding, and quenching the steel, thereby manufacturing a high-strength gear having reduced distortion.

However, with this method, resistance to softening is low due to a small amount of Si in the steel used. This leads to a problem in that, in an application where the produced gear is used at a high rotational speed, temperatures on the surface increase, and the surface is softened, whereby pitting resistance reduces.

Patent Document 3 discloses a case hardened steel having thermal treatment distortion reduced in a similar manner. However, this case hardened steel has a large amount of C, and hence, has a problem of deterioration in machinability, cold working characteristics, toughness or other characteristics.

Patent Document 4 discloses a steel for gears, in which an ideal critical diameter after carburizing processes is defined, and an inner portion of the metal where carburizing and nitriding are not applied after carburizing and quenching has a carburized and quenched structure having reduced distortion with ferrite: 10 to 70%. However, this steel for gears has a problem of deterioration in characteristics related to carburizing due to a large amount of Si, and deterioration in machinability and a cold working characteristic.

Patent Document 5 discloses a method of reducing the thermal treatment distortion by appropriately adjusting chemical components in steel, and employing appropriate conditions for carburizing processes. Further, Patent Document 6 discloses a method of reducing distortion after thermal treatments by controlling critical cooling rates using the amount of C or the amount of Mn in steel.

Patent Documents 7 and 8 disclose a method of applying quenching processes after case-hardening processes by setting a quenching starting temperature depending on chemical components, thereby adjusting an area fraction of proeutectoid ferrite in a structure of a core portion after the case-hardening process, in other words, a structure of a non-carburized layer so as to fall in the range of 20 to 80%.

Patent Document 9 discloses a method of reducing an amount of distortion by applying processes of carburizing, cooling, reheating, and quenching, thereby reducing the thermal treatment distortion and improving bending fatigue strength. However, with this method, it is not possible to prevent deterioration in productivity and increase in costs of thermal treatments resulting from reheating and quenching.

Patent Document 10 discloses a steel for nitriding that does not have any substantial white band, in which pressure is applied to unsolidified regions under specific conditions, electro-magnetic stirring is not performed at solidification end positions so as not to generate any white band, the degree of segregation C/Co at a D/4 portion is set so as to fall in a range of 0.99 to 1.01.

Patent Document 11 discloses a case hardened steel in which a difference between the maximum value and the minimum value of the degree of micro-segregation of C and Mn in a cross section of bloom in a radial direction is not more than 0.03%, and a difference in contents adjacent to each other is not more than 0.02%. Further, Patent Document 12 discloses a case hardened steel having reduced distortion and manufactured from a bloom having a degree of segregation of C at the center in a range of 1.1 to 1.0.

However, in reality, any of the methods and steels described above cannot achieve the reduction in distortion that satisfies the severe demands made by recent consumers.

RELATED ART DOCUMENT(S)

Patent Document

Patent Document 1: Japanese Unexamined Patent Application, First Publication No. H05-070924

Patent Document 2: Japanese Unexamined Patent Application, First Publication No. H05-070925

Patent Document 3: Japanese Unexamined Patent Application, First Publication No. S58-113316

Patent Document 4: Japanese Unexamined Patent Application, First Publication No. H08-109435

Patent Document 5: Japanese Unexamined Patent Application, First Publication No. H02-298250

Patent Document 6: Japanese Unexamined Patent Application, First Publication No. S61-210154

Patent Document 7: Japanese Unexamined Patent Application, First Publication No. H09-137266

Patent Document 8: Japanese Unexamined Patent Application, First Publication No. H10-147814

Patent Document 9: Japanese Unexamined Patent Application, First Publication No. H05-148535

Patent Document 10: Japanese Unexamined Patent Application, First Publication No. 2000-343191

Patent Document 11: Japanese Unexamined Patent Application, First Publication No. 2006-097066

Patent Document 12: Japanese Unexamined Patent Application, First Publication No. S58-052459

DISCLOSURE OF THE INVENTION

Problems to be Solved by the Invention

In view of the circumstances described above, the present invention has a problem of, in quenching processes using carburizing and nitriding applied to a case hardened steel, reducing, as much as possible, the thermal treatment distortion that is caused through the quenching processes. An object of the present invention is to solve this problem, and to provide a case hardened steel product exhibiting excellent wear resistance and fatigue strength, and having high dimensional accuracy.

Means for Solving the Problem

The following are main points of the present invention.

(1) The first aspect of the present invention provides a case hardened steel having a cross section having a macrostructure including an equiaxed zone and a columnar zone disposed around the equiaxed zone. The case hardened steel has a composition including, in mass %: C: 0.05 to 0.45%; Si: 0.01 to 1.0%; Mn: over 0 to 2.0%; Al: 0.001 to 0.06%; N: 0.002 to 0.03%; S: over 0 to 0.1%; P: over 0 to 0.05%; and balance: Fe and inevitable impurities, in which Equation (a) described below and Equation (b) described below are satisfied in the equiaxed zone, or Equation (c) described below is satisfied in the columnar zone.

$$Re=(Ae/Ao)\times 100\leq 30\% \quad \text{Equation (a)}$$

$$(C\text{min}, 1/Co)\geq \mathbf{0.95} \quad \text{Equation (b)}$$

$$(C\text{min}, 2/Co)\geq \mathbf{0.95} \quad \text{Equation (c)}$$

where,

Re: area fraction (%) of the equiaxed zone,

Ae: area of the equiaxed zone,

Ao: area of the cross section,

Co: average concentration (mass %) of C in the cross section, or concentration (mass %) of C in molten steel in a ladle or continuous casting tundish, Cmin, 1: minimum concentration (mass %) of C in the equiaxed zone, and Cmin, 2: minimum concentration (mass %) of C in the columnar zone.

(2) In the case hardened steel according to (1) described above, Equation (a) and Equation (b) may be satisfied in the equiaxed zone, and Equation (c) may be satisfied in the columnar zone.

(3) In the case hardened steel according to (1) or (2) described above, at least one of Equation (d) described below and Equation (e) described below may be satisfied in the equiaxed zone.

$$(L/F)\geq 0.6 \quad \text{Equation (d)}$$

$$(L/S)\geq 0.6 \quad \text{Equation (e)}$$

where,

L: distance (mm) from the center of a cross section to a position closest to the center of the cross section and located on a periphery of the equiaxed zone, F: distance (mm) from the center of the cross section to a position located on the periphery of the equiaxed zone and in a direction opposed, with respect to the center of the cross section, to the position closest to the center of the cross section and located on the periphery of the equiaxed zone, and S: larger distance (mm) from among distances from the center of the cross section to positions at which the periphery of the equiaxed zone crosses a line passing through the center of the cross section of all lines perpendicular to a line connecting the center of the cross section and a position closest to the center of the cross section and located on the periphery of the equiaxed zone.

(4) In the case hardened steel according to (3) described above, Equation (d) and Equation (e) may be satisfied in the equiaxed zone.

(5) In the case hardened steel according to any one of (1) to (4) described above, the composition may further include at least one of, in mass %, Mo: over 0 to 1.5%; V: over 0 to 1.5%; Nb: over 0 to 1.5%; Cu: over 0 to 1.0%; Ni: over 0 to 2.5%; Cr: over 0 to 2.0%; and Sn: over 0 to 1.0%.

(6) In the case hardened steel according to any one of (1) to (5) described above, the composition may further include at least one of, in mass %: Ca: over 0 to 0.01%; Zr: over 0 to 0.08%; Pb: over 0 to 0.4%; Bi: over 0 to 0.3%; Te: over 0 to 0.3%; Rem: over 0 to 0.1%; and Sb: over 0 to 0.1%.

(7) In the case hardened steel according to any one of (1) to (6) described above, the composition may further include at least one of, in mass %: Ti: over 0 to 0.30%; and B: over 0 to 0.005%.

(8) In the case hardened steel according to any one of (1) to (7) described above, the composition may further include, in mass %, W: over 0 to 2.0%.

(9) The second aspect of the present invention provides a mechanical component obtained by machining the case hardened steel according to any one of (1) to (8) described above, and applying a thermal treatment to the machined case hardened steel.

Effects of the Invention

According to the present invention, it is possible to provide a case hardened steel product having reduced thermal treatment distortion caused through the quenching processes using carburizing and nitriding, having high dimensional accuracy, and exhibiting excellent fatigue characteristics. Further, by machining the case hardened steel described above and applying thermal treatments to this case hardened steel, it is possible to provide mechanical components having reduced noise and vibration, and having improved fatigue life.

EMBODIMENTS OF THE INVENTION

Figure 1:
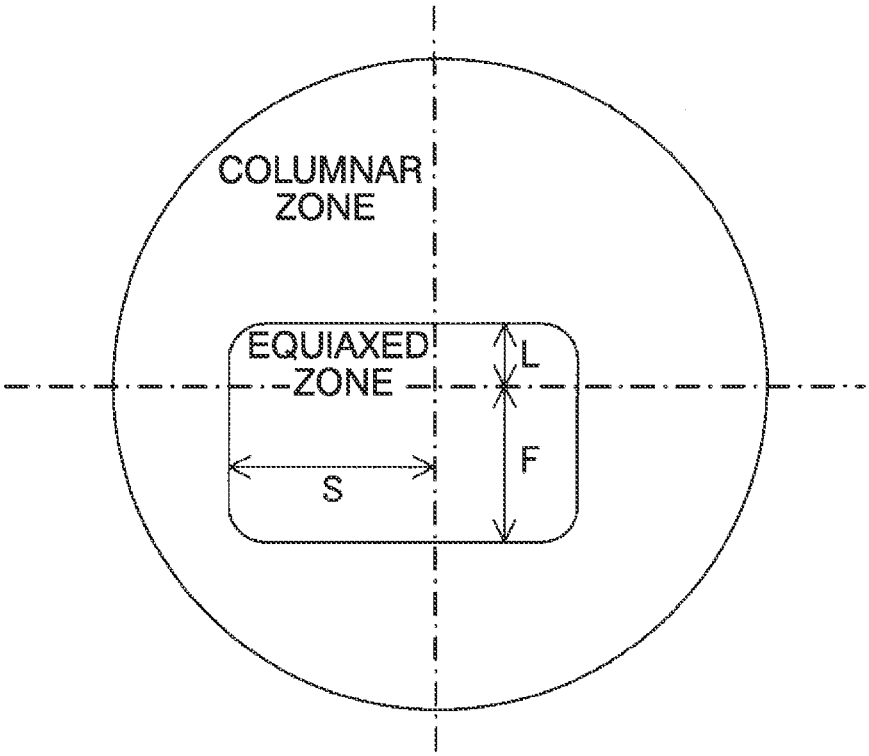
FIG. 1 is a diagram schematically illustrating imbalance of equiaxed zone in a macrostructure in a cross section of a steel.

In this specification, the present invention will be described with focus placed on application of the present invention to gears. However, the application target of a case hardened steel according to the present invention is not limited to the gears. The case hardened steel according to the present invention can be used for mechanical components having a surface layer portion hardened through the quenching processes, in particular, for mechanical components required to have a reduced amount of distortion after quenching processes using carburizing and nitriding.

In order to solve the problems of the present invention and achieve the object of the present invention described above, the present inventors first carried out a study of factors affecting the thermal treatment distortion. As a result, they found that the factors that largely affect the thermal treatment distortion include, in a macrostructure (solidification structure) in a cross section of steel:

(a) reduction in the concentration of C;
(b) the area of and the area fraction of an equiaxed zone in which concentrations of dissolved matters are more likely to be nonuniform, and
(c) reduction in the concentration of C in the equiaxed zone and a columnar zone around the equiaxed zone.

Further, the present inventors continued the thorough investigation, and as a result, found that the thermal treatment distortion can be reduced to the level that satisfies the recent consumers' severe demand, by performing the following, in the macrostructure (solidification structure) in a cross section of steel:

(x) reducing the size of the equiaxed zone and then, suppressing a reduction in the concentration of C in the equiaxed zone;
(y) suppressing a reduction in the concentration of C in the columnar zone around the equiaxed zone; or
(z) bringing the distribution of the equiaxed zone closer to axial symmetry in a cross section in steel, or by combining two or more of (x), (y), and (z).

In the equiaxed zone in the macrostructure in a cross section of steel, the concentration of C or other elements tends to decrease from the outer peripheral portion toward the center of the cross section. Thus, if the equiaxed zone is not in axial symmetry in the cross section, the thermal treatment distortion increases because of:

(A) nonuniformity of the amount of swelling resulting from martensite transformation occurring through quenching processes using carburizing and nitriding;
(B) time lag between occurrences of martensite transformations; and
(C) nonuniformity of mechanical properties in the circumferential direction after the martensite transformation.

On the other hand, by bringing the distribution of the equiaxed zone close to the axial symmetry in the macrostructure in the cross section in the steel, the points (A), (B), and (C) described above are corrected, and hence, the thermal treatment distortion is reduced.

Further, by reducing the equiaxed zone in the macrostructure in the cross section of the steel, preventing the concentration of C in the equiaxed zone from decreasing, or suppressing the reduction in the concentration of C in the columnar zone around the equiaxed zone, it is possible to, in the equiaxed zone or columnar zone around the equiaxed zone, reduce the amount of swelling resulting from transformation occurring through the quenching processes using carburizing and nitriding, the time lag between the times when respective martensite transformations occur, and nonuniformity of mechanical properties in the circumferential direction after the martensite transformation, thereby reducing the thermal treatment distortion.

More specifically, the thermal treatment distortion can be effectively reduced, by, in the macrostructure in the cross section of the steel, setting an area fraction (Re=Ae/Ao) of an area (Ae) of the equiaxed zone relative to an area (Ao) of the cross section so as to be not more than 30%; and setting a ratio (Cmin, 1/Co) of the minimum concentration of C (Cmin, 1) (mass %) in the equiaxed zone in the cross section of the steel relative to the average concentration of C (Co) (mass %) in the cross section of the steel or the concentration of C (Co) (mass %) in the molten steel in a ladle or a continuous casting tundish so as to be not less than 0.95.

Further, the thermal treatment distortion can be further reduced, by quantitatively identifying the degree of imbalance (see FIG. 1) of the equiaxed zone in the macrostructure in the cross section of the steel as indices (L/F) and (L/S), where L, F, and S are defined below, and maintaining the (L/F) and/or the (L/S) to be not less than 0.6.

L: distance (mm) from the center of a cross section of steel to a position closest to the center of the cross section of the steel and located on the periphery of the equiaxed zone in the macrostructure in the cross section of the steel.

F: distance (mm) from the center of a cross section of steel to a position located on the periphery of the equiaxed zone and in a direction opposed, with respect to the center of the cross section, to the position closest to the center of the cross section and located on the periphery of the equiaxed zone in the macrostructure in the cross section of the steel.

S: larger distance (mm) among distances from the center of the cross section of steel to positions at which the periphery of the equiaxed zone crosses a line passing through the center of the cross section of all lines perpendicular to a line connecting the center of the cross section and the position closest to the center of the cross section and located on the periphery of the equiaxed zone in the macrostructure in the cross section of the steel.

Further, the thermal treatment distortion can be further reduced, by maintaining a ratio (Cmin, 2/Co) of Cmin, 2 (mass %), which represents the minimum concentration of C (mass %) in the columnar zone around the equiaxed zone in the macrostructure in the cross section of the steel, relative to the average concentration C (Co) (mass %) in the cross section of the steel or the concentration of C (Co) (mass %) in a molten steel in a ladle or a continuous casting tundish so as to be not less than 0.95.

As described above, the thermal treatment distortion can be stably reduced, if:

(a) Equation (1) and Equation (2) described below are satisfied; or
(b) Equation (3) described below is satisfied. Further, the thermal treatment distortion can be reduced in various applications, if
(c) all of Equation (1) to Equation (3) described below are satisfied.

Further, the thermal treatment distortion can be further stably reduced for mechanical components having various shapes, if:

(d) either of or both of Equation (4) and Equation (5) described below are satisfied.

$$Re=(Ae/Ao)\times 100\leq 30\% \quad \text{Equation (1)}$$

$$(Cmin,1/Co)\geq 0.95 \quad \text{Equation (2)}$$

$$(Cmin,2/Co)\geq 0.95 \quad \text{Equation (3)}$$

$$(L/F)\geq 0.6 \quad \text{Equation (4)}$$

$$(L/S)\geq 0.6 \quad \text{Equation (5)}$$

The measurement of L, F, and S in the equiaxed zone in the macrostructure in the cross section of the steel, the measurement of the minimum concentration of C in the equiaxed zone, and the measurement of the minimum concentration of C in a columnar band zone may be performed for any form of the following steel: bloom, a steel piece, rolled steel, and a mechanical component obtained by machining rolled steel.

The equiaxed zone or the columnar zone in the macrostructure in the cross section of the steel may be made appear through etching using hydrochloric acid-based etching reagent, picric acid-based etching reagent, or Oberhofer's reagent, or may be made appear through a sulfur print method or an etch print method. Alternatively, the equiaxed zone or the columnar zone may be identified through elemental mapping (area analysis) for a solidification structure using EPMA or other various types of electron microscopes.

Cmin, 1 of the equiaxed zone and Cmin, 2 of the columnar zone are evaluated, by, after the macrostructure is examined, chemically analyzing cuttings obtained from each of the zones, for example, through drilling or step cutting method, or measuring the distribution of the concentration of C in each of the zones through Quantvac method, or measuring the distribution of the concentration of C through EPMA or other elemental mapping, or line analysis method.

Co may be obtained by measuring the average concentration of C in the cross section of the steel through the methods described above, or may be obtained through chemical analysis applied to samples of molten steel taken with a ladle or continuous casting tundish, or through analysis using the Quantvac method.

According to the present invention, it is possible to reduce circumferential non-uniformity of hardenability and mechanical properties in the cross section of the case hardened steel, by limiting the area fraction of the equiaxed zone in the cross section of the case hardened steel subjected to the quenching processes using carburizing and nitriding, suppressing formation of negative segregation in the equiaxed zone or the columnar zone around the equiaxed zone, and correcting imbalance of the distribution or shape of the equiaxed zone in the cross section. Accordingly, it is possible to provide case hardened steel products having the reduced thermal treatment distortion caused through the quenching processes using carburizing and nitriding, having improved dimensional accuracy, and exhibiting excellent fatigue characteristics.

Next, descriptions will be made of reasons for limiting chemical components in the case hardened steel according to the present invention. Note that "%" means mass %.

C: 0.05 to 0.45%

C is an element essential for securing internal strength sufficient to make the steel function when used as mechanical components. If the amount of C is less than 0.05%, the sufficient internal strength cannot be obtained. Thus, the lower limit is set to 0.05%. If the amount of C exceeds 0.45%, toughness deteriorates, and machinability or cold forgeability deteriorates, whereby workability deteriorates. Thus, the upper limit is set to 0.45%.

Preferably, the lower limit of the amount of C is set to 0.10%. More preferably, the lower limit is set to 0.20%.

Preferably, the upper limit of the amount of C is set to 0.30%. More preferably, the upper limit is set to 0.25%.

Si: 0.01 to 1.0%

Si functions as a deoxidizing agent at the time of smelting, and has a function of increasing a transformation point, and enhancing the internal strength. Further, Si has a function of separating the internal structure into two phases at normal quenching temperatures (800 to 1050° C.) and suppressing the thermal treatment distortion.

The amount of Si added is set to 0.01% or more to obtain an additive effect. However, if the amount of Si contained exceeds 1.0%, intergranular oxidation advances, bending fatigue strength deteriorates, and cold forgeability or machinability deteriorates. Thus, the upper limit is set to 1.0%. In the case where a gas carburizing and nitriding method is used as a case hardening method, carburizing and nitriding are hindered if the amount of Si exceeds 1.0%. Thus, for this reason, the upper limit is set to 1.0%.

Preferably, the lower limit of the amount of Si is set to 0.15%, and more preferably, the lower limit is set to 0.30%.

Preferably, the upper limit of the amount of Si is set to 0.7%, and more preferably, the upper limit is set to 0.6%.

Mn: over 0 to 2.0%

Mn is an element that functions as a deoxidizing agent, and contributes to improving strength and hardenability. However, if the amount of Mn exceeds 2.0%, cold working characteristics deteriorate, and the amount of segregation to grain boundaries increases, which results in a deterioration in bending fatigue characteristics. Thus, the upper limit is set to 2.0%. Preferably, the upper limit is set to 1.5% or less. The lower limit is set to over 0%. However, in order to reliably obtain the additive effect, it is preferable to set the lower limit to 0.3% or more.

Al: 0.001 to 0.06%

Al is an element that functions as a deoxidizing agent, bonds to N in the steel to form AlN, and has a function of preventing crystal grains from coarsening. In order to obtain the deoxidizing effect, the amount of Al added is set to 0.001% or more. If the amount of Al exceeds 0.06%, the additive effect saturates, and Al bonds to oxygen to form non-metal-based inclusions that adversely affect impact characteristics. Thus, the upper limit is set to 0.06%.

Preferably, the lower limit of the amount of Al is set to 0.005%, and more preferably, the lower limit is set to 0.01%.

Preferably, the upper limit of the amount of Al is set to 0.04%, and more preferably, the upper limit is set to 0.03%.

N: 0.002 to 0.03%

N is an element that bonds, for example, to Al, V, Ti, and Nb in the steel, and forms nitrides that suppress coarsening of crystal grains. In order to obtain the additive effects, the amount of N added is set to 0.002% or more. Preferably, the amount of N added is set to 0.007% or more. If the amount of N exceeds 0.03%, the additive effects saturate, and the formed nitrides serve as inclusions and have adverse effects on characteristics. Thus, the upper limit of N is set to 0.03%. Preferably, the upper limit is set to 0.01% or less.

P: over 0 to 0.05%

P is an element that is segregated in grain boundaries, and deteriorates toughness. Thus, the upper limit of P is set to 0.05%. Preferably, the upper limit is set to 0.03% or less. It is preferable that P is as low as possible, and the lower limit is over 0%. However, in general, approximately 0.001% of P inevitably exists.

S: over 0 to 0.1%

S is an element that suppresses decarbonization in the surface layer during thermal treatments, and improves machinability. If the amount of S exceeds 0.1%, hot workability or fatigue characteristics deteriorate. Thus, the upper limit is set to 0.1%. In the case of gears, attention should be paid not only to vertical-impact characteristics but also to transverse-impact characteristics. Thus, in order to enhance the transverse-impact characteristics by reducing anisotropy, it is preferable to set the amount of S to 0.03% or less. More preferably, the amount of S is set to 0.01% or less.

The balance of the case hardened steel according to the present invention includes Fe and inevitable impurities. However, it is possible to improve the characteristics by further adding, as selective elements, at least one of the following:

Mo: over 0 to 1.5%,
V: over 0 to 1.5%,
Nb: over 0 to 1.5%,
Cu: over 0 to 1.0%,
Ni: over 0 to 2.5%,
Cr: over 0 to 2.0%, and
Sn: over 0 to 1.0%

Mo, V, and Nb are elements that each have functions of increasing the transformation points, enabling the internal structure to be separated into two phases even at normal quenching temperatures (800 to 1050° C.), and suppressing the thermal treatment distortion. Mo is an element that contributes to improving grain boundary strength, reducing an imperfectly quenched structure, and improving hardenability. However, if the amount of Mo exceeds 1.5%, the additive effects saturate. Thus, the upper limit is set to 1.5%, preferably 1.0% or less.

V and Nb are elements that each bond to C or N to form carbonitrides and make crystal grain finer, and contribute to improving toughness. However, if the amount of V exceeds 1.5%, machinability deteriorates. Thus, the upper limit of V is set to 1.5%. If the amount of Nb exceeds 1.5%, workability deteriorates. Thus, the upper limit of Nb is set to 1.5%.

Preferably, the lower limit of each of Mo, V, and Nb is set to 0.005%.

Preferably, the upper limit of each of Mo, V, and Nb is set to 1.0%.

Cu, Ni, Cr, and Sn are elements that each contribute to separating the internal structure into two phases. Cu and Sn are elements that contribute to improving a corrosion resistance. If each of Cu and Sn exceeds 1.0%, the additive effects saturate, and hot workability deteriorates. Thus, the upper limit of each of Cu and Sn is set to 1.0%. Preferably, the upper limit of each of Cu and Sn is set to 0.6% or less.

It should be noted that addition of Cu alone, or addition of Cu and Sn in a combined manner has a significant adverse effect on the hot workability. Thus, in the case where Cu is added alone, or Cu and Sn are added in a combined manner, it is preferable to add Ni approximately equal to or more than the amount of Cu added.

Ni is an element that makes the structures finer after quench hardening to enhance toughness, contributes to improving workability, and contributes to stably securing internal hardness. If the amount of N exceeds 2.5%, the additive effects saturate. Thus, the upper limit is set to 2.5%. Preferably, the upper limit is set to 2.0% or less.

Cr is an element that provides a function of enhancing hardenability to increase the internal hardness. However, if the amount of Cr exceeds 2.0%, carbides precipitate at grain boundaries, the strength at grain boundaries deteriorates, and toughness deteriorates. Thus, the upper limit is set to 2.0%. Preferably, the upper limit is set to 1.5% or less.

In order to improve characteristics, the case hardened steel according to the present invention may further contain, as a selective element, at least one of the following:

Ca: over 0 to 0.01%,
Zr: over 0 to 0.08%,
Pb: over 0 to 0.4%,
Bi: over 0 to 0.3%,
Te: over 0 to 0.3%,
Rem (rare earth metal such as Ce, La, and Nb): over 0% to 0.1%, and
Sb: over 0 to 0.1%.

Ca is an element that softens hard oxide to enhance machinability. However, if the amount of Ca exceeds 0.01%, the additive effects saturate. Thus, the upper limit is set to 0.01%. Preferably, the upper limit is set to 0.007% or less.

Zr is an element that makes MnS have a spherical shape to improve anisotropy, and enhances machinability. However, if the amount of Ca exceeds 0.08%, the additive effects saturate. Thus, the upper limit is set to 0.08%. Preferably, the upper limit is set to 0.05% or less.

Pb, Bi, Te, Rem (rare earth metal such as Ce, La, and Nb), and Sb are elements that each contribute to improving machinability, prevent sulfides from elongating, thereby suppressing deterioration in toughness or other mechanical properties resulting from sulfides, or increase in anisotropy. The excessive amount of these elements causes a significant adverse effect on pitting life or fatigue strength. Thus, the amount of Pb is set to 0.40% or less, the amount of each of Bi and Te is set to 0.3% or less, and the amount of each of Rem and Sb is set to 0.1% or less. Preferably, the amount of Pb is set to 0.30% or less, the amount of each of Bi and Te is set to 0.2% or less, and the amount of each of Rem and Sb is set to 0.06% or less.

In order to improve characteristics, the case hardened steel according to the present invention may further contain at least one of the following:

Ti: over 0% to 0.3%, and
B: over 0% to 0.005% or less.

Ti is an element that bonds to N to form nitrides, make crystal grains finer, and contributes to improving toughness. The excessive amount of Ti causes an adverse effect on pitting life or machinability. Thus, the upper limit is set to 0.1%.

Preferably, the lower limit of Ti is set to 0.005%. More preferably, the lower limit of Ti is set to 0.010%.

Preferably, the upper limit of Ti is set to 0.05%. More preferably, the upper limit of Ti is set to 0.02%.

B is an element that contributes to improving hardenability. However, the additive effects saturate if the amount of B reaches 0.005%. Thus, the upper limit of B is set to 0.005%. Preferably, the upper limit of B is set to 0.002% or less.

W: over 0% to 2.0%

In order to improve characteristics, the case hardened steel according to the present invention may further contain W: over 0% to 2.0%.

An appropriate amount of W added is effective in improving hardenability and improving strength through strengthening of ferrite. However, the additive effects saturate if the amount of W reaches 2.0%. Thus, the upper limit is set to 2.0%. Preferably, the upper limit is set to 1.5% or less.

The case hardened steel according to the present invention is a steel having the chemical components described above, in which the area fraction of the equiaxed zone in the cross section of the steel, the degree of negative segregation of the equiaxed zone, the shape or imbalance of the equiaxed zone, and the degree of negative segregation of the columnar zone satisfy Equation (1) and Equation (2), or Equation (3), and further satisfy Equation (4) and/or Equation (5) as needed. Thus, by applying the quenching processes using carburizing and nitriding to the steel that has been formed into mechanical components, it is possible to obtain mechanical components having high dimensional accuracy, having improved surface hardness, and exhibiting excellent wear resistance.

The quenching processes using carburizing and nitriding employed in the present invention are not limited to specific processes, and it may be possible to employ, for example, known gas carburizing (or carbonitriding), pack carburizing (or carbonitriding), salt bath carburizing (or carbonitriding), plasma carburizing (or carbonitriding), or vacuum carburizing (or carbonitriding). Note that, in the case of obtaining case hardened steel products having a significantly high-level toughness, it is desirable to apply the quenching processes using carburizing and nitriding, and then, apply a tempering process at temperatures in the range of approximately 100 to 200° C.

The fatigue strength can be further improved by applying a shot peening process to the case hardened steel product to provide compressive residual stress to the surface thereof, after the quenching processes using carburizing and nitriding are applied or after the quenching processes using carburizing and nitriding are applied and then a tempering process is applied. Preferably, conditions for the shot peening process are set, for example, such that shot particles having shot hardness of HRC 45 or more and particle size in the rage of 0.04 to 1.5 mm are used, and an arc height (value indicating a height of deformation of the surface resulting from shot peening) is set to 0.2 to 1.2 mmA.

If the hardness of the shot particles is less than HRC 45 or the arc height is less than 0.2 mmA, it is not possible to provide a sufficient compressive residual stress to the surface of the case hardened steel product. On the other hand, if the arc height exceeds 1.2 mmA, over shot peening occurs, which has an adverse effect on the fatigue characteristics. The upper limit of the hardness of the shot particles is not specifically limited. However, practically, the upper limit is approximately HRC 65. Although no specific limitation is applied to the particle size of the shot particles, the particle size is set preferably to fall in a range of 0.04 to 1.5 mm, more preferably 0.3 to 1.0 mm.

In general, the shot peening process is performed once sufficiently. However, the shot peening process may be repeated for two or more times depending on applications.

EXAMPLES

Next, by giving Examples, the configuration and operational effects of the present invention will be described more specifically. However, there is no limitation applied to the present invention with Examples described below, and any modifications may be applied and performed, provided that such modifications conform to the scope of the present invention. Further, such modifications are included in the technical scope of the present invention.

Examples

Steels having the chemical composition shown in Tables 1 to 4 and 7 to 10 were casted through normal continuous casting using a mold having a square shaped in cross section with thickness 220 mm×width 220 mm, or a mold having a rectangle shape in cross section with thickness 350 mm×width 560 mm. Tables 1 to 4 show Examples according to the present invention, and Tables 7 to 10 show Comparative Examples. In the tables, chemical components together with Re (%), (Cmin, 1/Co), (Cmin, 2/Co), (L/F) and (L/S) are shown. Further, in the tables, "tr" means that the amount of a corresponding element is extremely small to the extent that the amount of the corresponding element contained can be ignored.

Re, (Cmin, 1/Co), (Cmin, 2/Co), (L/F), and (L/S) of the steels according to the present invention and steels according to comparative examples were adjusted in the following manner.

For example, (a) vary the superheat of molten steel in a tundish; (b) vary the strength of electro-magnetic stiffing in the mold; and (c) vary the casting speed. Further, for some of the blooms, soft reduction at the late stage of solidification was applied to suppress negative segregation in the equiaxed zone, thereby varying the area of and the area fraction of the equiaxed zone in the cross section of the steel, the shape and the imbalance of the equiaxed zone in the cross section, the concentration of C in the equiaxed zone, and the distribution of the concentration of C in the columnar zone around the equiaxed zone.

With decrease of the superheat of the molten steel in the tundish, the area fraction of the equiaxed zone increases. With increase in the strength of electro-magnetic stirring in the mold, the area fraction of the equiaxed zone increases. Further, in the case where casting is performed with a mold having a flattened rectangular cross section, the cross-sectional shape of the equiaxed zone is more likely to be flattened, as compared with the case where a mold having a square cross section is used.

With increase in the casting speed in the continuous casting process, equiaxed grains are more likely to move down toward the lower surface of the bloom, whereby the equiaxed zone is positioned in an imbalanced manner toward the lower surface of the bloom in the cross section. With increase in the strength of the electro-magnetic stirring in the mold, the concentration of C in the columnar zone on the surface layer side decreases. By applying soft reduction at the late stage of solidification, it is possible to suppress centerline segregation or formation of negative segregation in the surrounding zone, whereby it is possible to suppress the reduction in the concentration of C within the equiaxed zone.

The blooms obtained by casting under various casting conditions were subjected to billet mill to form steel pieces with a 162 mm square, and then were formed into steel bars with 25 mmϕ and 48 mmϕ through hot rolling. The steel bars with 25 mmϕ were maintained at 900° C. for one hour, then were subjected to a normalizing process with air cooling, and were cut into pieces each having a length of 200 mm. Then, the surface layers of the pieces thus obtained were cut, and then were machined into test pieces with a bar shape with 22 mmϕ×length 200 mm.

The steel bars with 48 mmϕ were maintained at 900° C. for one hour, then were subjected to a normalizing process with air cooling, and were cut into pieces each having a length of 15 mm. Then, the surface layers of the pieces thus obtained were cut, and then were machined to obtain pieces having an outside diameter of 45 mmϕ. The center portion of each of the pieces thus obtained was hollowed to obtain ring-shaped test pieces having an inside diameter 26 mmϕ× an outside diameter 45 mmϕ×a height 15 mm.

Figure 2:
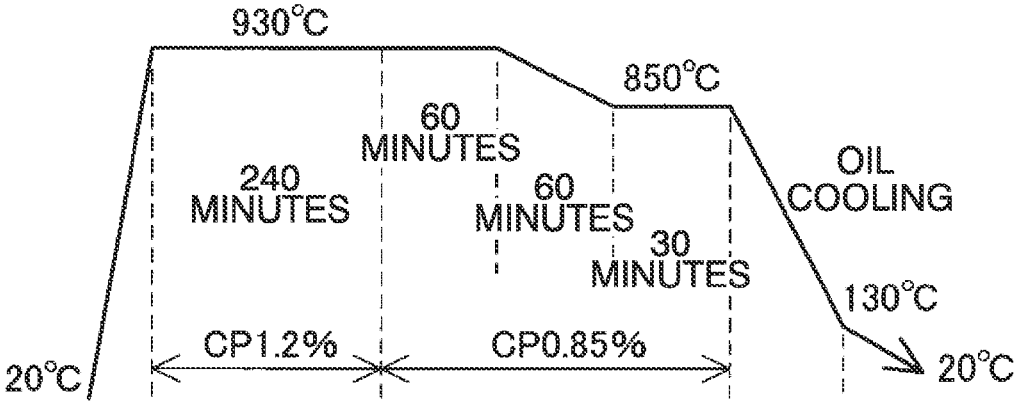
FIG. 2 is a diagram illustrating conditions for carburizing and quenching applied in Example.

These test pieces were used to perform a carburizing and quenching test under conditions shown in FIG. 2. The number of test pieces used for performing the carburizing and quenching test were five for each condition. Then, the degree of off-center rotation and the roundness of each of the test pieces were measured to evaluate the thermal treatment distortion, and calculate the average value of the five test pieces.

For the carburizing and quenching, one test piece was processed at a time. Note that, at the time of oil quenching, the bar-shaped test pieces were immersed in a vertical position relative to the oil surface and the ring-shaped test pieces were immersed in a position in which the upper and the lower surfaces of each of the test pieces were parallel to the oil surface, so that variation in the methods or conditions of carburizing and quenching does not affect the thermal treatment distortion.

Before and after the carburizing and quenching test, for the bar-shaped test pieces with 22 mmϕ×length 200 mm, test pieces were rotated in the circumferential direction with the cross-sectional center of both ends of each of the test pieces serving as a center; measurement was made of the amount of bending, which corresponds to the degree of off-center rotation at the center in the longitudinal direction; and the average value of the results was calculated. For the ring-shaped test pieces, the roundness was measured at three points in the height direction of each of the test pieces along the inner circumference and the outer circumference to calculate the average value of the results. The average values were calculated with n=5.

Tables 5, 6, 11, and 12 show the average values of the maximum amount of bending of the bar-shaped test pieces, and the average values of the maximum values of roundness of the ring-shaped test pieces.

Further, samples for observing structures were taken from the test pieces after the carburizing and quenching, and were etched with a picric acid-based etching reagent to make macrostructures appear. Then, Ae, L, F, and S were measured to calculate Re, L/F, and L/S. Elemental mapping was applied to the samples with EPMA, and Cmin, 1 in the equiaxed zone and Cmin, 2 in the columnar zone were obtained. Then, the concentration Co of C of the molten steel in the tundish was obtained to calculate (Cmin, 1/Co) and (Cmin, 2/Co). The calculation results are shown in Tables 5, 6, 11, and 12.

For Examples (Ex. 1 to Ex. 100) shown in Tables 1 to 6, the maximum amount (average value in the case of n=five test pieces) of bending measured after the bar-shaped test pieces were subjected to carburizing and quenching is reduced to 15 μm or less, and the maximum value (average value in the case of n=five test pieces) of roundness measured after the ring-shaped test pieces were subjected to carburizing and quenching is reduced to 10 μm or less.

On the other hand, for Comparative Examples (Comp. Ex. 1 to Comp. Ex. 79) shown in Tables 7 to 12, the maximum amount of bending measured after the bar-shaped test pieces were subjected to carburizing and quenching results in 20 μm or more, and the maximum value of roundness measured after the ring-shaped test pieces were subjected to carburizing and quenching results in 15 μm or more, each of which is greater than values of examples according to the present invention by 5 μm or more.

TABLE 1

| Example No. | C | Si | Mn | P | S | Al | N |
|---|---|---|---|---|---|---|---|
| | | | | mass % | | | |
| Ex. 1 | 0.19 | 0.25 | 0.02 | 0.013 | 0.009 | 0.031 | 0.0022 |
| Ex. 2 | 0.43 | 0.02 | 0.75 | 0.015 | 0.008 | 0.033 | 0.0055 |
| Ex. 3 | 0.18 | 0.95 | 0.77 | 0.014 | 0.010 | 0.002 | 0.0053 |
| Ex. 4 | 0.21 | 0.24 | 1.95 | 0.012 | 0.007 | 0.032 | 0.0058 |
| Ex. 5 | 0.05 | 0.25 | 0.76 | 0.048 | 0.007 | 0.035 | 0.0060 |
| Ex. 6 | 0.21 | 0.24 | 0.73 | 0.015 | 0.010 | 0.057 | 0.0054 |
| Ex. 7 | 0.22 | 0.25 | 0.74 | 0.001 | 0.008 | 0.036 | 0.0292 |
| Ex. 8 | 0.18 | 0.26 | 0.76 | 0.015 | 0.008 | 0.002 | 0.0055 |
| Ex. 9 | 0.44 | 0.25 | 0.77 | 0.014 | 0.010 | 0.035 | 0.0023 |
| Ex. 10 | 0.21 | 0.97 | 0.75 | 0.003 | 0.007 | 0.033 | 0.0055 |
| Ex. 11 | 0.22 | 0.27 | 1.97 | 0.015 | 0.008 | 0.037 | 0.0054 |
| Ex. 12 | 0.20 | 0.26 | 0.03 | 0.049 | 0.010 | 0.034 | 0.0055 |

TABLE 1-continued

| Example No. | C | Si | Mn | P | S | Al | N |
|---|---|---|---|---|---|---|---|
| | | | | mass % | | | |
| Ex. 13 | 0.06 | 0.24 | 0.76 | 0.013 | 0.007 | 0.057 | 0.0055 |
| Ex. 14 | 0.20 | 0.02 | 0.73 | 0.015 | 0.008 | 0.034 | 0.0295 |
| Ex. 15 | 0.19 | 0.25 | 0.02 | 0.013 | 0.009 | 0.031 | 0.0022 |
| Ex. 16 | 0.43 | 0.02 | 0.75 | 0.015 | 0.008 | 0.033 | 0.0055 |
| Ex. 17 | 0.18 | 0.95 | 0.77 | 0.014 | 0.010 | 0.002 | 0.0053 |
| Ex. 18 | 0.21 | 0.24 | 1.95 | 0.012 | 0.007 | 0.032 | 0.0058 |
| Ex. 19 | 0.05 | 0.25 | 0.76 | 0.048 | 0.007 | 0.035 | 0.0060 |
| Ex. 20 | 0.21 | 0.24 | 0.73 | 0.015 | 0.010 | 0.057 | 0.0054 |
| Ex. 21 | 0.22 | 0.25 | 0.74 | 0.001 | 0.008 | 0.036 | 0.0292 |
| Ex. 22 | 0.21 | 0.26 | 0.74 | 0.013 | 0.010 | 0.003 | 0.0053 |
| Ex. 23 | 0.43 | 0.25 | 0.76 | 0.015 | 0.008 | 0.032 | 0.0055 |
| Ex. 24 | 0.20 | 0.96 | 0.77 | 0.014 | 0.010 | 0.037 | 0.0053 |
| Ex. 25 | 0.21 | 0.23 | 1.99 | 0.012 | 0.007 | 0.034 | 0.0058 |
| Ex. 26 | 0.19 | 0.26 | 0.76 | 0.049 | 0.007 | 0.035 | 0.0060 |
| Ex. 27 | 0.05 | 0.01 | 0.73 | 0.015 | 0.010 | 0.057 | 0.0054 |
| Ex. 28 | 0.22 | 0.25 | 0.74 | 0.013 | 0.011 | 0.036 | 0.0289 |
| Ex. 29 | 0.21 | 0.26 | 0.74 | 0.013 | 0.010 | 0.003 | 0.0053 |
| Ex. 30 | 0.43 | 0.25 | 0.76 | 0.015 | 0.008 | 0.032 | 0.0055 |
| Ex. 31 | 0.20 | 0.96 | 0.77 | 0.014 | 0.010 | 0.037 | 0.0053 |
| Ex. 32 | 0.21 | 0.23 | 1.99 | 0.012 | 0.007 | 0.034 | 0.0058 |
| Ex. 33 | 0.19 | 0.26 | 0.76 | 0.049 | 0.007 | 0.035 | 0.0060 |
| Ex. 34 | 0.05 | 0.01 | 0.73 | 0.015 | 0.010 | 0.057 | 0.0054 |
| Ex. 35 | 0.22 | 0.25 | 0.74 | 0.013 | 0.011 | 0.036 | 0.0289 |
| Ex. 36 | 0.21 | 0.26 | 0.74 | 0.013 | 0.010 | 0.003 | 0.0053 |
| Ex. 37 | 0.43 | 0.25 | 0.76 | 0.015 | 0.008 | 0.032 | 0.0055 |
| Ex. 38 | 0.20 | 0.96 | 0.77 | 0.014 | 0.010 | 0.037 | 0.0053 |
| Ex. 39 | 0.21 | 0.23 | 1.99 | 0.012 | 0.007 | 0.034 | 0.0058 |
| Ex. 40 | 0.19 | 0.26 | 0.76 | 0.049 | 0.007 | 0.035 | 0.0060 |
| Ex. 41 | 0.05 | 0.01 | 0.73 | 0.015 | 0.010 | 0.057 | 0.0054 |
| Ex. 42 | 0.22 | 0.25 | 0.74 | 0.013 | 0.011 | 0.036 | 0.0289 |
| Ex. 43 | 0.20 | 0.26 | 0.02 | 0.015 | 0.099 | 0.034 | 0.0051 |
| Ex. 44 | 0.44 | 0.25 | 0.77 | 0.015 | 0.007 | 0.003 | 0.0025 |
| Ex. 45 | 0.20 | 0.98 | 0.75 | 0.014 | 0.007 | 0.033 | 0.0053 |
| Ex. 46 | 0.21 | 0.24 | 1.94 | 0.012 | 0.010 | 0.037 | 0.0058 |
| Ex. 47 | 0.22 | 0.26 | 0.73 | 0.047 | 0.008 | 0.034 | 0.0060 |
| Ex. 48 | 0.20 | 0.24 | 0.74 | 0.013 | 0.001 | 0.057 | 0.0054 |
| Ex. 49 | 0.21 | 0.02 | 0.73 | 0.015 | 0.010 | 0.036 | 0.0286 |
| Ex. 50 | 0.06 | 0.26 | 0.74 | 0.013 | 0.007 | 0.034 | 0.0052 |

TABLE 2

| Example No. | C | Si | Mn | P | S | Al | N |
|---|---|---|---|---|---|---|---|
| | | | | mass % | | | |
| Ex. 51 | 0.20 | 0.01 | 0.76 | 0.015 | 0.008 | 0.035 | 0.0022 |
| Ex. 52 | 0.44 | 0.25 | 0.77 | 0.003 | 0.010 | 0.033 | 0.0053 |
| Ex. 53 | 0.21 | 0.94 | 0.75 | 0.014 | 0.007 | 0.037 | 0.0058 |
| Ex. 54 | 0.22 | 0.27 | 1.98 | 0.012 | 0.007 | 0.034 | 0.0060 |
| Ex. 55 | 0.05 | 0.26 | 0.74 | 0.048 | 0.010 | 0.034 | 0.0054 |
| Ex. 56 | 0.22 | 0.24 | 0.02 | 0.013 | 0.008 | 0.057 | 0.0055 |
| Ex. 57 | 0.20 | 0.26 | 0.73 | 0.015 | 0.008 | 0.034 | 0.0290 |
| Ex. 58 | 0.20 | 0.26 | 0.74 | 0.015 | 0.010 | 0.001 | 0.0051 |
| Ex. 59 | 0.21 | 0.02 | 0.76 | 0.013 | 0.007 | 0.034 | 0.0023 |
| Ex. 60 | 0.43 | 0.25 | 0.77 | 0.002 | 0.008 | 0.035 | 0.0053 |
| Ex. 61 | 0.20 | 0.95 | 0.75 | 0.016 | 0.010 | 0.034 | 0.0058 |
| Ex. 62 | 0.22 | 0.27 | 1.95 | 0.015 | 0.008 | 0.037 | 0.0060 |
| Ex. 63 | 0.20 | 0.27 | 0.73 | 0.047 | 0.008 | 0.034 | 0.0054 |
| Ex. 64 | 0.06 | 0.24 | 0.74 | 0.013 | 0.010 | 0.057 | 0.0055 |
| Ex. 65 | 0.20 | 0.25 | 0.02 | 0.015 | 0.007 | 0.036 | 0.0296 |
| Ex. 66 | 0.20 | 0.26 | 0.74 | 0.013 | 0.008 | 0.036 | 0.0021 |
| Ex. 67 | 0.43 | 0.25 | 0.76 | 0.015 | 0.008 | 0.035 | 0.0055 |
| Ex. 68 | 0.20 | 0.97 | 0.77 | 0.014 | 0.010 | 0.033 | 0.0053 |
| Ex. 69 | 0.21 | 0.27 | 1.96 | 0.012 | 0.007 | 0.037 | 0.0058 |
| Ex. 70 | 0.22 | 0.26 | 0.03 | 0.049 | 0.008 | 0.034 | 0.0060 |
| Ex. 71 | 0.05 | 0.25 | 0.73 | 0.013 | 0.010 | 0.057 | 0.0054 |
| Ex. 72 | 0.21 | 0.02 | 0.74 | 0.015 | 0.009 | 0.036 | 0.0292 |
| Ex. 73 | 0.22 | 0.26 | 0.73 | 0.013 | 0.095 | 0.002 | 0.0049 |
| Ex. 74 | 0.20 | 0.25 | 0.74 | 0.002 | 0.008 | 0.035 | 0.0055 |
| Ex. 75 | 0.44 | 0.25 | 0.76 | 0.014 | 0.008 | 0.034 | 0.0053 |
| Ex. 76 | 0.22 | 0.96 | 0.77 | 0.012 | 0.010 | 0.037 | 0.0058 |
| Ex. 77 | 0.20 | 0.02 | 1.97 | 0.015 | 0.007 | 0.034 | 0.0024 |
| Ex. 78 | 0.06 | 0.26 | 0.73 | 0.049 | 0.008 | 0.034 | 0.0054 |
| Ex. 79 | 0.22 | 0.24 | 0.74 | 0.014 | 0.002 | 0.057 | 0.0055 |
| Ex. 80 | 0.20 | 0.25 | 0.02 | 0.015 | 0.008 | 0.032 | 0.0291 |

TABLE 2-continued

| Example No. | C | Si | Mn | P | S | Al | N |
|---|---|---|---|---|---|---|---|
| | | | | mass % | | | |
| Ex. 81 | 0.19 | 0.25 | 0.01 | 0.001 | 0.009 | 0.031 | 0.0050 |
| Ex. 82 | 0.43 | 0.26 | 0.76 | 0.015 | 0.008 | 0.002 | 0.0055 |
| Ex. 83 | 0.21 | 0.02 | 0.74 | 0.013 | 0.010 | 0.033 | 0.0053 |
| Ex. 84 | 0.05 | 0.26 | 0.76 | 0.015 | 0.099 | 0.034 | 0.0051 |
| Ex. 85 | 0.20 | 0.25 | 0.76 | 0.015 | 0.008 | 0.035 | 0.0021 |
| Ex. 86 | 0.20 | 0.25 | 1.97 | 0.015 | 0.007 | 0.034 | 0.0060 |
| Ex. 87 | 0.19 | 0.25 | 0.02 | 0.013 | 0.009 | 0.031 | 0.0022 |
| Ex. 88 | 0.43 | 0.02 | 0.75 | 0.015 | 0.008 | 0.033 | 0.0055 |
| Ex. 89 | 0.18 | 0.95 | 0.77 | 0.014 | 0.010 | 0.002 | 0.0053 |
| Ex. 90 | 0.21 | 0.24 | 1.95 | 0.012 | 0.007 | 0.032 | 0.0058 |
| Ex. 91 | 0.05 | 0.25 | 0.76 | 0.048 | 0.007 | 0.035 | 0.0060 |

TABLE 2-continued

| Example No. | C | Si | Mn | P | S | Al | N |
|---|---|---|---|---|---|---|---|
| | | | | mass % | | | |
| Ex. 92 | 0.21 | 0.24 | 0.73 | 0.015 | 0.010 | 0.057 | 0.0054 |
| Ex. 93 | 0.22 | 0.25 | 0.74 | 0.001 | 0.008 | 0.036 | 0.0292 |
| Ex. 94 | 0.18 | 0.26 | 0.76 | 0.015 | 0.008 | 0.002 | 0.0055 |
| Ex. 95 | 0.44 | 0.25 | 0.77 | 0.014 | 0.010 | 0.035 | 0.0023 |
| Ex. 96 | 0.21 | 0.97 | 0.75 | 0.003 | 0.007 | 0.033 | 0.0055 |
| Ex. 97 | 0.22 | 0.27 | 1.97 | 0.015 | 0.008 | 0.037 | 0.0054 |
| Ex. 98 | 0.20 | 0.26 | 0.03 | 0.049 | 0.010 | 0.034 | 0.0055 |
| Ex. 99 | 0.06 | 0.24 | 0.76 | 0.013 | 0.007 | 0.057 | 0.0055 |
| Ex. 100 | 0.20 | 0.02 | 0.73 | 0.015 | 0.008 | 0.034 | 0.0295 |

TABLE 3

| Example No. | Mo | V | Nb | Cu | Ni | Cr | Sn | Ca | Zr | Pb | Bi | Te | Rem | Sb | Ti | B | W |
|---|---|---|---|---|---|---|---|---|---|---|---|---|---|---|---|---|---|
| | | | | | | | mass % | | | | | | | | | | |
| Ex. 1 | tr | tr | tr | tr | tr | tr | tr | tr | tr | tr | tr | tr | tr | tr | tr | tr | tr |
| Ex. 2 | tr | tr | tr | tr | tr | tr | tr | tr | tr | tr | tr | tr | tr | tr | tr | tr | tr |
| Ex. 3 | tr | tr | tr | tr | tr | tr | tr | tr | tr | tr | tr | tr | tr | tr | tr | tr | tr |
| Ex. 4 | tr | tr | tr | tr | tr | tr | tr | tr | tr | tr | tr | tr | tr | tr | tr | tr | tr |
| Ex. 5 | tr | tr | tr | tr | tr | tr | tr | tr | tr | tr | tr | tr | tr | tr | tr | tr | tr |
| Ex. 6 | tr | tr | tr | tr | tr | tr | tr | tr | tr | tr | tr | tr | tr | tr | tr | tr | tr |
| Ex. 7 | tr | tr | tr | tr | tr | tr | tr | tr | tr | tr | tr | tr | tr | tr | tr | tr | tr |
| Ex. 8 | tr | tr | tr | tr | tr | tr | tr | tr | tr | tr | tr | tr | tr | tr | tr | tr | tr |
| Ex. 9 | tr | tr | tr | tr | tr | tr | tr | tr | tr | tr | tr | tr | tr | tr | tr | tr | tr |
| Ex. 10 | tr | tr | tr | tr | tr | tr | tr | tr | tr | tr | tr | tr | tr | tr | tr | tr | tr |
| Ex. 11 | tr | tr | tr | tr | tr | tr | tr | tr | tr | tr | tr | tr | tr | tr | tr | tr | tr |
| Ex. 12 | tr | tr | tr | tr | tr | tr | tr | tr | tr | tr | tr | tr | tr | tr | tr | tr | tr |
| Ex. 13 | tr | tr | tr | tr | tr | tr | tr | tr | tr | tr | tr | tr | tr | tr | tr | tr | tr |
| Ex. 14 | tr | tr | tr | tr | tr | tr | tr | tr | tr | tr | tr | tr | tr | tr | tr | tr | tr |
| Ex. 15 | tr | tr | tr | tr | tr | tr | tr | tr | tr | tr | tr | tr | tr | tr | tr | tr | tr |
| Ex. 16 | tr | tr | tr | tr | tr | tr | tr | tr | tr | tr | tr | tr | tr | tr | tr | tr | tr |
| Ex. 17 | tr | tr | tr | tr | tr | tr | tr | tr | tr | tr | tr | tr | tr | tr | tr | tr | tr |
| Ex. 18 | tr | tr | tr | tr | tr | tr | tr | tr | tr | tr | tr | tr | tr | tr | tr | tr | tr |
| Ex. 19 | tr | tr | tr | tr | tr | tr | tr | tr | tr | tr | tr | tr | tr | tr | tr | tr | tr |
| Ex. 20 | tr | tr | tr | tr | tr | tr | tr | tr | tr | tr | tr | tr | tr | tr | tr | tr | tr |
| Ex. 21 | tr | tr | tr | tr | tr | tr | tr | tr | tr | tr | tr | tr | tr | tr | tr | tr | tr |
| Ex. 22 | tr | tr | tr | tr | tr | tr | tr | tr | tr | tr | tr | tr | tr | tr | tr | tr | tr |
| Ex. 23 | tr | tr | tr | tr | tr | tr | tr | tr | tr | tr | tr | tr | tr | tr | tr | tr | tr |
| Ex. 24 | tr | tr | tr | tr | tr | tr | tr | tr | tr | tr | tr | tr | tr | tr | tr | tr | tr |
| Ex. 25 | tr | tr | tr | tr | tr | tr | tr | tr | tr | tr | tr | tr | tr | tr | tr | tr | tr |
| Ex. 26 | tr | tr | tr | tr | tr | tr | tr | tr | tr | tr | tr | tr | tr | tr | tr | tr | tr |
| Ex. 27 | tr | tr | tr | tr | tr | tr | tr | tr | tr | tr | tr | tr | tr | tr | tr | tr | tr |
| Ex. 28 | tr | tr | tr | tr | tr | tr | tr | tr | tr | tr | tr | tr | tr | tr | tr | tr | tr |
| Ex. 29 | tr | tr | tr | tr | tr | tr | tr | tr | tr | tr | tr | tr | tr | tr | tr | tr | tr |
| Ex. 30 | tr | tr | tr | tr | tr | tr | tr | tr | tr | tr | tr | tr | tr | tr | tr | tr | tr |
| Ex. 31 | tr | tr | tr | tr | tr | tr | tr | tr | tr | tr | tr | tr | tr | tr | tr | tr | tr |
| Ex. 32 | tr | tr | tr | tr | tr | tr | tr | tr | tr | tr | tr | tr | tr | tr | tr | tr | tr |
| Ex. 33 | tr | tr | tr | tr | tr | tr | tr | tr | tr | tr | tr | tr | tr | tr | tr | tr | tr |
| Ex. 34 | tr | tr | tr | tr | tr | tr | tr | tr | tr | tr | tr | tr | tr | tr | tr | tr | tr |
| Ex. 35 | tr | tr | tr | tr | tr | tr | tr | tr | tr | tr | tr | tr | tr | tr | tr | tr | tr |
| Ex. 36 | tr | tr | tr | tr | tr | tr | tr | tr | tr | tr | tr | tr | tr | tr | tr | tr | tr |
| Ex. 37 | tr | tr | tr | tr | tr | tr | tr | tr | tr | tr | tr | tr | tr | tr | tr | tr | tr |
| Ex. 38 | tr | tr | tr | tr | tr | tr | tr | tr | tr | tr | tr | tr | tr | tr | tr | tr | tr |
| Ex. 39 | tr | tr | tr | tr | tr | tr | tr | tr | tr | tr | tr | tr | tr | tr | tr | tr | tr |
| Ex. 40 | tr | tr | tr | tr | tr | tr | tr | tr | tr | tr | tr | tr | tr | tr | tr | tr | tr |
| Ex. 41 | tr | tr | tr | tr | tr | tr | tr | tr | tr | tr | tr | tr | tr | tr | tr | tr | tr |
| Ex. 42 | tr | tr | tr | tr | tr | tr | tr | tr | tr | tr | tr | tr | tr | tr | tr | tr | tr |
| Ex. 43 | tr | tr | 0.01 | tr | tr | tr | tr | tr | tr | tr | tr | tr | tr | tr | tr | tr | tr |
| Ex. 44 | 1.45 | tr | tr | tr | tr | 0.02 | tr | tr | tr | tr | tr | tr | tr | tr | tr | tr | tr |
| Ex. 45 | tr | 1.47 | tr | 0.02 | 0.01 | tr | tr | tr | tr | tr | tr | tr | tr | tr | tr | tr | tr |
| Ex. 46 | tr | tr | 1.45 | tr | tr | tr | tr | tr | tr | tr | tr | tr | tr | tr | tr | tr | tr |
| Ex. 47 | tr | 0.01 | tr | 0.98 | 0.95 | tr | tr | tr | tr | tr | tr | tr | tr | tr | tr | tr | tr |
| Ex. 48 | tr | tr | tr | tr | 2.47 | tr | 0.01 | tr | tr | tr | tr | tr | tr | tr | tr | tr | tr |
| Ex. 49 | 0.01 | tr | tr | tr | tr | 1.97 | tr | tr | tr | tr | tr | tr | tr | tr | tr | tr | tr |
| Ex. 50 | tr | tr | tr | tr | tr | tr | 0.90 | tr | tr | tr | tr | tr | tr | tr | tr | tr | tr |

TABLE 4

| Example No. | Mo | V | Nb | Cu | Ni | Cr | Sn | Ca | Zr | Pb | Bi | Te | Rem | Sb | Ti | B | W |
|---|---|---|---|---|---|---|---|---|---|---|---|---|---|---|---|---|---|
| | | | | | | | | | mass % | | | | | | | | |
| Ex. 51 | tr | tr | tr | tr | tr | tr | tr | 0.0090 | tr | tr | 0.01 | tr | 0.001 | tr | tr | tr | tr |
| Ex. 52 | tr | tr | tr | tr | tr | tr | tr | tr | 0.075 | tr | tr | 0.02 | tr | tr | tr | tr | tr |
| Ex. 53 | tr | tr | tr | tr | tr | tr | tr | tr | 0.002 | 0.38 | tr | tr | tr | tr | tr | tr | tr |
| Ex. 54 | tr | tr | tr | tr | tr | tr | tr | tr | tr | tr | 0.29 | tr | tr | 0.001 | tr | tr | tr |
| Ex. 55 | tr | tr | tr | tr | tr | tr | tr | tr | tr | 0.01 | tr | 0.30 | tr | tr | tr | tr | tr |
| Ex. 56 | tr | tr | tr | tr | tr | tr | tr | 0.0003 | tr | tr | tr | tr | 0.098 | tr | tr | tr | tr |
| Ex. 57 | tr | tr | tr | tr | tr | tr | tr | tr | tr | tr | tr | tr | tr | 0.097 | tr | tr | tr |
| Ex. 58 | tr | tr | tr | tr | tr | tr | tr | 0.0087 | tr | tr | tr | 0.01 | tr | tr | tr | tr | tr |
| Ex. 59 | tr | tr | tr | tr | tr | tr | tr | tr | 0.078 | tr | tr | tr | 0.002 | tr | tr | tr | tr |
| Ex. 60 | tr | tr | tr | tr | tr | tr | tr | tr | 0.003 | 0.37 | 0.01 | tr | tr | tr | tr | tr | tr |
| Ex. 61 | tr | tr | tr | tr | tr | tr | tr | 0.0002 | tr | tr | 0.28 | tr | tr | 0.002 | tr | tr | tr |
| Ex. 62 | tr | tr | tr | tr | tr | tr | tr | tr | tr | tr | tr | 0.30 | tr | tr | tr | tr | tr |
| Ex. 63 | tr | tr | tr | tr | tr | tr | tr | tr | tr | tr | tr | tr | tr | tr | tr | tr | tr |
| Ex. 64 | tr | tr | tr | tr | tr | tr | tr | tr | tr | tr | tr | tr | 0.096 | tr | tr | tr | tr |
| Ex. 65 | tr | tr | tr | tr | tr | tr | tr | tr | tr | 0.01 | tr | tr | tr | 0.098 | tr | tr | tr |
| Ex. 66 | tr | tr | tr | tr | tr | tr | tr | 0.0085 | tr | 0.01 | tr | tr | tr | tr | tr | tr | tr |
| Ex. 67 | tr | tr | tr | tr | tr | tr | tr | 0.0002 | 0.078 | tr | tr | tr | tr | tr | tr | tr | tr |
| Ex. 68 | tr | tr | tr | tr | tr | tr | tr | tr | tr | 0.36 | tr | tr | tr | tr | tr | tr | tr |
| Ex. 69 | tr | tr | tr | tr | tr | tr | tr | tr | tr | tr | 0.27 | tr | tr | tr | tr | tr | tr |
| Ex. 70 | tr | tr | tr | tr | tr | tr | tr | tr | tr | tr | tr | 0.29 | tr | tr | tr | tr | tr |
| Ex. 71 | tr | tr | tr | tr | tr | tr | tr | tr | 0.002 | tr | tr | tr | 0.098 | tr | tr | tr | tr |
| Ex. 72 | tr | tr | tr | tr | tr | tr | tr | tr | tr | tr | tr | tr | tr | 0.099 | tr | tr | tr |
| Ex. 73 | tr | tr | tr | tr | tr | tr | tr | tr | tr | tr | tr | tr | tr | tr | tr | tr | tr |
| Ex. 74 | 1.47 | tr | tr | tr | tr | tr | 0.01 | tr | 0.079 | tr | tr | tr | tr | 0.001 | tr | tr | tr |
| Ex. 75 | tr | 1.45 | 0.01 | tr | tr | tr | tr | tr | tr | 0.39 | tr | tr | 0.001 | tr | tr | tr | tr |
| Ex. 76 | tr | tr | 1.48 | tr | tr | 0.02 | tr | tr | tr | tr | 0.29 | tr | tr | tr | tr | tr | tr |
| Ex. 77 | tr | tr | tr | 0.99 | 0.97 | tr | tr | tr | tr | tr | 0.01 | 0.29 | tr | tr | tr | tr | tr |
| Ex. 78 | 0.01 | tr | tr | 0.01 | 2.48 | tr | tr | tr | 0.001 | 0.01 | tr | tr | 0.095 | tr | tr | tr | tr |
| Ex. 79 | tr | tr | tr | tr | tr | 1.95 | tr | tr | tr | tr | tr | 0.01 | tr | 0.096 | tr | tr | tr |
| Ex. 80 | tr | tr | tr | tr | 0.02 | tr | 0.90 | tr | tr | 0.39 | tr | tr | tr | tr | tr | tr | tr |
| Ex. 81 | tr | tr | tr | tr | tr | tr | tr | tr | tr | tr | tr | tr | tr | tr | 0.003 | 0.0003 | tr |
| Ex. 82 | tr | tr | tr | tr | tr | tr | tr | tr | tr | tr | tr | tr | tr | tr | 0.280 | 0.0048 | tr |
| Ex. 83 | tr | tr | tr | tr | tr | tr | tr | tr | tr | tr | tr | tr | tr | tr | 0.013 | 0.0022 | tr |
| Ex. 84 | tr | tr | tr | tr | tr | tr | tr | tr | tr | tr | tr | tr | tr | tr | 0.005 | 0.0003 | tr |
| Ex. 85 | tr | tr | tr | tr | tr | tr | tr | 0.0090 | tr | tr | 0.01 | tr | tr | tr | 0.019 | 0.0025 | tr |
| Ex. 86 | tr | tr | tr | 0.99 | 0.97 | tr | tr | 0.0002 | tr | tr | tr | 0.29 | tr | tr | 0.013 | 0.0039 | tr |
| Ex. 87 | tr | tr | tr | tr | tr | tr | tr | tr | tr | tr | tr | tr | tr | tr | tr | tr | 1.97 |
| Ex. 88 | tr | tr | tr | tr | tr | tr | tr | tr | tr | tr | tr | tr | tr | tr | tr | tr | tr |
| Ex. 89 | tr | tr | tr | tr | tr | tr | tr | tr | tr | tr | tr | tr | tr | tr | tr | tr | tr |
| Ex. 90 | tr | tr | tr | tr | tr | tr | tr | tr | tr | tr | tr | tr | tr | tr | tr | tr | tr |
| Ex. 91 | tr | tr | tr | tr | tr | tr | tr | tr | tr | tr | tr | tr | tr | tr | tr | tr | tr |
| Ex. 92 | tr | tr | tr | tr | tr | tr | tr | tr | tr | tr | tr | tr | tr | tr | 0.019 | tr | tr |
| Ex. 93 | tr | tr | tr | tr | tr | tr | tr | tr | tr | tr | tr | tr | tr | tr | tr | 0.0025 | tr |
| Ex. 94 | tr | tr | tr | tr | tr | tr | tr | tr | tr | tr | tr | tr | tr | tr | tr | tr | 1.95 |
| Ex. 95 | tr | tr | tr | tr | tr | tr | tr | tr | tr | tr | tr | tr | tr | tr | tr | tr | tr |
| Ex. 96 | tr | tr | tr | tr | tr | tr | tr | tr | tr | tr | tr | tr | tr | tr | tr | tr | tr |
| Ex. 97 | tr | tr | tr | tr | tr | tr | tr | tr | tr | tr | tr | tr | tr | tr | tr | tr | tr |
| Ex. 98 | tr | tr | tr | tr | tr | tr | tr | tr | tr | tr | tr | tr | tr | tr | tr | tr | tr |
| Ex. 99 | tr | tr | tr | tr | tr | tr | tr | tr | tr | tr | tr | tr | tr | tr | 0.019 | tr | tr |
| Ex. 100 | tr | tr | tr | tr | tr | tr | tr | tr | tr | tr | tr | tr | tr | tr | tr | 0.0025 | tr |

TABLE 5

| Example No. | Rc % | Cmin, 1 — | Cmin, 2 — | L/F — | L/S — | Maximum bending amount (Bar-shaped test piece) μm | Maximum roundness value (Ring-shaped test piece) μm |
|---|---|---|---|---|---|---|---|
| Ex. 1 | 20.3 | 0.95 | 0.98 | 0.69 | 0.65 | 14.9 | — |
| Ex. 2 | 27.8 | 0.97 | 0.96 | 0.62 | 0.74 | 8.0 | — |
| Ex. 3 | 24.3 | 0.99 | 0.95 | 0.75 | 0.72 | 11.8 | — |
| Ex. 4 | 25.6 | 0.96 | 0.97 | 0.81 | 0.80 | 13.7 | — |
| Ex. 5 | 27.8 | 0.95 | 1.00 | 0.95 | 0.92 | 8.4 | — |
| Ex. 6 | 20.1 | 0.97 | 0.98 | 0.91 | 0.84 | 10.7 | — |
| Ex. 7 | 29.8 | 0.97 | 0.97 | 0.82 | 0.88 | 13.2 | — |
| Ex. 8 | 24.6 | 0.96 | 0.95 | 0.72 | 0.74 | — | 10.0 |
| Ex. 9 | 19.3 | 0.97 | 0.96 | 0.75 | 0.70 | — | 9.0 |
| Ex. 10 | 24.3 | 1.00 | 0.97 | 0.65 | 0.68 | — | 8.0 |
| Ex. 11 | 25.6 | 0.96 | 0.99 | 0.73 | 0.69 | — | 7.1 |
| Ex. 12 | 25.6 | 0.96 | 0.96 | 0.67 | 0.78 | — | 9.9 |
| Ex. 13 | 27.8 | 0.95 | 0.95 | 0.82 | 0.86 | — | 7.7 |
| Ex. 14 | 28.9 | 0.97 | 0.95 | 0.69 | 0.72 | — | 9.3 |

TABLE 5-continued

| Example No. | Rc % | Cmin, 1 — | Cmin, 2 — | L/F — | L/S — | Maximum bending amount (Bar-shaped test piece) μm | Maximum roundness value (Ring-shaped test piece) μm |
|---|---|---|---|---|---|---|---|
| Ex. 15 | 20.0 | 0.96 | 0.96 | 0.65 | 0.67 | 14.9 | — |
| Ex. 16 | 27.0 | 0.97 | 0.97 | 0.85 | 0.85 | 8.0 | — |
| Ex. 17 | 24.3 | 1.00 | 0.95 | 0.72 | 0.74 | 11.8 | — |
| Ex. 18 | 25.6 | 0.96 | 0.95 | 0.66 | 0.65 | 13.7 | — |
| Ex. 19 | 26.8 | 0.97 | 1.00 | 0.96 | 0.69 | 8.4 | — |
| Ex. 20 | 20.1 | 0.98 | 0.99 | 0.68 | 0.65 | 10.7 | — |
| Ex. 21 | 28.9 | 0.97 | 0.96 | 0.79 | 0.75 | 13.2 | — |
| Ex. 22 | 24.6 | 0.96 | 0.99 | 0.80 | 0.97 | 10.7 | 7.1 |
| Ex. 23 | 19.3 | 0.97 | 0.97 | 0.96 | 0.97 | 9.0 | 8.5 |
| Ex. 24 | 21.1 | 0.98 | 0.96 | 0.75 | 0.86 | 11.8 | 9.9 |
| Ex. 25 | 25.0 | 0.99 | 0.97 | 0.97 | 0.97 | 10.9 | 9.0 |
| Ex. 26 | 27.8 | 0.95 | 0.98 | 0.98 | 1.00 | 10.6 | 7.7 |
| Ex. 27 | 24.3 | 0.96 | 0.96 | 0.69 | 0.85 | 15.0 | 9.8 |
| Ex. 28 | 25.6 | 0.95 | 0.97 | 0.72 | 0.85 | 13.2 | 10.0 |
| Ex. 29 | 18.7 | 0.97 | 0.99 | 0.85 | 0.71 | 10.0 | 6.2 |
| Ex. 30 | 18.3 | 0.99 | 0.97 | 0.91 | 0.85 | 9.0 | 8.0 |
| Ex. 31 | 21.1 | 0.98 | 0.96 | 0.82 | 0.83 | 11.8 | 9.9 |
| Ex. 32 | 25.2 | 0.98 | 0.97 | 0.75 | 0.78 | 11.1 | 8.8 |
| Ex. 33 | 27.8 | 0.95 | 0.98 | 0.79 | 0.62 | 11.6 | 7.8 |
| Ex. 34 | 24.3 | 0.97 | 0.96 | 0.66 | 0.65 | 15.0 | 9.9 |
| Ex. 35 | 24.6 | 0.95 | 0.97 | 0.70 | 0.67 | 13.2 | 9.8 |
| Ex. 36 | 17.5 | 0.99 | 0.99 | 0.85 | 0.84 | 9.9 | 7.5 |
| Ex. 37 | 19.5 | 0.98 | 0.97 | 0.88 | 0.92 | 9.0 | 8.6 |
| Ex. 38 | 23.4 | 0.96 | 0.96 | 0.82 | 0.82 | 12.0 | 9.0 |
| Ex. 39 | 20.5 | 0.96 | 0.97 | 0.66 | 0.64 | 10.1 | 9.9 |
| Ex. 40 | 20.0 | 0.97 | 0.98 | 0.79 | 0.62 | 10.3 | 7.7 |
| Ex. 41 | 26.8 | 0.95 | 0.96 | 0.71 | 0.65 | 14.9 | 9.9 |
| Ex. 42 | 25.1 | 0.95 | 0.97 | 0.63 | 0.67 | 13.1 | 9.8 |
| Ex. 43 | 27.8 | 0.97 | 0.95 | 0.65 | 0.62 | 13.8 | — |
| Ex. 44 | 28.5 | 0.97 | 0.96 | 0.76 | 0.81 | — | 9.9 |
| Ex. 45 | 29.8 | 0.96 | 0.97 | 0.66 | 0.65 | 11.8 | — |
| Ex. 46 | 27.8 | 0.96 | 0.97 | 0.66 | 0.65 | 13.7 | 9.8 |
| Ex. 47 | 24.3 | 0.97 | 1.00 | 0.82 | 0.85 | 8.4 | — |
| Ex. 48 | 18.0 | 0.97 | 0.98 | 0.91 | 0.87 | — | 6.2 |
| Ex. 49 | 27.8 | 0.96 | 0.96 | 0.66 | 0.62 | 13.2 | — |
| Ex. 50 | 20.1 | 0.96 | 0.99 | 0.77 | 0.66 | 14.9 | 6.0 |

TABLE 6

| Example No. | Rc % | Cmin, 1 — | Cmin, 2 — | L/F — | L/S — | Maximum bending amount (Bar-shaped test piece) μm | Maximum roundness value (Ring-shaped test piece) μm |
|---|---|---|---|---|---|---|---|
| Ex. 51 | 21.1 | 0.98 | 0.99 | 0.80 | 0.82 | 8.0 | — |
| Ex. 52 | 25.0 | 0.99 | 0.96 | 0.75 | 0.71 | 11.8 | — |
| Ex. 53 | 27.8 | 0.95 | 0.95 | 0.79 | 0.62 | 13.7 | — |
| Ex. 54 | 24.3 | 0.95 | 0.98 | 0.67 | 0.62 | 11.3 | — |
| Ex. 55 | 25.6 | 0.95 | 0.99 | 0.98 | 0.67 | 8.4 | — |
| Ex. 56 | 27.8 | 0.97 | 0.96 | 0.65 | 0.62 | 13.2 | — |
| Ex. 57 | 20.1 | 0.97 | 0.96 | 0.76 | 0.70 | 10.0 | — |
| Ex. 58 | 28.5 | 0.96 | 0.99 | 0.65 | 0.67 | — | 7.5 |
| Ex. 59 | 21.1 | 0.98 | 0.96 | 0.68 | 0.72 | — | 9.0 |
| Ex. 60 | 25.2 | 0.98 | 0.97 | 0.62 | 0.75 | — | 9.3 |
| Ex. 61 | 27.8 | 0.95 | 0.96 | 0.72 | 0.82 | — | 9.9 |
| Ex. 62 | 23.4 | 0.96 | 0.96 | 0.63 | 0.66 | — | 9.0 |
| Ex. 63 | 20.5 | 0.96 | 0.97 | 0.71 | 0.76 | — | 8.5 |
| Ex. 64 | 20.1 | 0.97 | 0.96 | 0.69 | 0.62 | — | 9.0 |
| Ex. 65 | 29.0 | 0.96 | 0.98 | 0.60 | 0.67 | — | 6.0 |
| Ex. 66 | 25.6 | 0.99 | 0.97 | 0.76 | 0.76 | 9.3 | — |
| Ex. 67 | 19.5 | 0.98 | 0.99 | 0.78 | 0.86 | 8.4 | 5.7 |
| Ex. 68 | 20.1 | 0.96 | 0.98 | 0.69 | 0.75 | 10.7 | 6.0 |
| Ex. 69 | 21.1 | 0.95 | 0.96 | 0.65 | 0.62 | 13.2 | — |
| Ex. 70 | 25.0 | 0.96 | 0.97 | 0.66 | 0.65 | 14.8 | 9.0 |
| Ex. 71 | 27.8 | 0.96 | 0.97 | 0.86 | 0.83 | 8.0 | — |
| Ex. 72 | 23.2 | 0.96 | 0.95 | 0.72 | 0.70 | 11.8 | 10.0 |
| Ex. 73 | 25.6 | 0.96 | 0.96 | 0.77 | 0.69 | 13.7 | — |
| Ex. 74 | 27.8 | 0.96 | 0.97 | 0.66 | 0.67 | 13.7 | — |

TABLE 6-continued

| Example No. | Rc % | Cmin, 1 — | Cmin, 2 — | L/F — | L/S — | Maximum bending amount (Bar-shaped test piece) μm | Maximum roundness value (Ring-shaped test piece) μm |
|---|---|---|---|---|---|---|---|
| Ex. 75 | 18.5 | 0.98 | 0.96 | 0.78 | 0.76 | 8.4 | 9.8 |
| Ex. 76 | 22.3 | 0.98 | 0.97 | 0.82 | 0.82 | 10.7 | — |
| Ex. 77 | 28.4 | 0.99 | 0.97 | 0.75 | 0.72 | 7.5 | 7.0 |
| Ex. 78 | 27.2 | 0.96 | 0.98 | 0.60 | 0.68 | 14.9 | 8.3 |
| Ex. 79 | 23.8 | 0.98 | 0.99 | 0.82 | 0.82 | 8.0 | 6.1 |
| Ex. 80 | 25.1 | 0.99 | 0.98 | 0.65 | 0.67 | 11.8 | — |
| Ex. 81 | 20.3 | 0.95 | 0.97 | 0.62 | 0.67 | 15.0 | — |
| Ex. 82 | 15.8 | 0.95 | 0.95 | 0.75 | 0.70 | — | 10.0 |
| Ex. 83 | 24.6 | 0.96 | 0.99 | 0.85 | 0.80 | 10.7 | 7.1 |
| Ex. 84 | 27.8 | 0.97 | 0.96 | 0.85 | 0.81 | 13.8 | — |
| Ex. 85 | 21.1 | 0.98 | 1.00 | 0.86 | 0.82 | 8.0 | — |
| Ex. 86 | 28.4 | 0.99 | 0.97 | 0.75 | 0.72 | 7.5 | 7.0 |
| Ex. 87 | 20.3 | 0.95 | 0.98 | 0.69 | 0.65 | 14.8 | — |
| Ex. 88 | 31.5 | 0.97 | 0.96 | 0.62 | 0.74 | 8.7 | — |
| Ex. 89 | 24.3 | 0.96 | 0.93 | 0.75 | 0.72 | 12.5 | — |
| Ex. 90 | 25.6 | 0.96 | 0.97 | 0.55 | 0.65 | 14.9 | — |
| Ex. 91 | 27.8 | 0.95 | 1.00 | 0.65 | 0.57 | 9.9 | — |
| Ex. 92 | 20.1 | 0.97 | 0.98 | 0.91 | 0.84 | 10.7 | — |
| Ex. 93 | 29.8 | 0.97 | 0.97 | 0.82 | 0.88 | 13.2 | — |
| Ex. 94 | 24.6 | 0.96 | 0.95 | 0.72 | 0.74 | — | 10.0 |
| Ex. 95 | 32.0 | 0.97 | 0.96 | 0.75 | 0.70 | — | 9.9 |
| Ex. 96 | 24.3 | 0.96 | 0.94 | 0.65 | 0.68 | — | 8.9 |
| Ex. 97 | 25.6 | 0.96 | 0.99 | 0.58 | 0.69 | — | 7.5 |
| Ex. 98 | 25.6 | 0.96 | 0.96 | 0.67 | 0.59 | — | 10.0 |
| Ex. 99 | 27.8 | 0.95 | 0.95 | 0.82 | 0.86 | — | 7.7 |
| Ex. 100 | 28.9 | 0.97 | 0.95 | 0.69 | 0.72 | — | 9.3 |

TABLE 7

| Comparative Example No. | C | Si | Mn | P | S | Al | N |
|---|---|---|---|---|---|---|---|
| | | | | mass % | | | |
| Comp. Ex. 1 | 0.18 | 0.25 | 0.74 | 0.015 | 0.008 | 0.033 | 0.0053 |
| Comp. Ex. 2 | 0.42 | 0.23 | 0.75 | 0.014 | 0.010 | 0.034 | 0.0550 |
| Comp. Ex. 3 | 0.19 | 0.96 | 0.77 | 0.012 | 0.007 | 0.032 | 0.0060 |
| Comp. Ex. 4 | 0.22 | 0.24 | 1.95 | 0.012 | 0.008 | 0.032 | 0.0058 |
| Comp. Ex. 5 | 0.20 | 0.24 | 0.74 | 0.048 | 0.007 | 0.035 | 0.0580 |
| Comp. Ex. 6 | 0.19 | 0.24 | 0.76 | 0.015 | 0.009 | 0.057 | 0.0054 |
| Comp. Ex. 7 | 0.22 | 0.25 | 0.77 | 0.013 | 0.008 | 0.036 | 0.0295 |
| Comp. Ex. 8 | 0.17 | 0.26 | 0.76 | 0.015 | 0.008 | 0.035 | 0.0055 |
| Comp. Ex. 9 | 0.43 | 0.25 | 0.77 | 0.014 | 0.010 | 0.033 | 0.0570 |
| Comp. Ex. 10 | 0.21 | 0.95 | 0.75 | 0.012 | 0.007 | 0.033 | 0.0055 |
| Comp. Ex. 11 | 0.21 | 0.26 | 1.97 | 0.015 | 0.007 | 0.037 | 0.0530 |
| Comp. Ex. 12 | 0.20 | 0.24 | 0.76 | 0.049 | 0.010 | 0.034 | 0.0520 |
| Comp. Ex. 13 | 0.22 | 0.25 | 0.74 | 0.013 | 0.007 | 0.056 | 0.0055 |
| Comp. Ex. 14 | 0.20 | 0.26 | 0.76 | 0.015 | 0.008 | 0.034 | 0.0295 |
| Comp. Ex. 15 | 0.22 | 0.24 | 0.77 | 0.013 | 0.009 | 0.035 | 0.0520 |
| Comp. Ex. 16 | 0.43 | 0.25 | 0.76 | 0.015 | 0.008 | 0.032 | 0.0050 |
| Comp. Ex. 17 | 0.20 | 0.97 | 0.77 | 0.014 | 0.005 | 0.035 | 0.0053 |
| Comp. Ex. 18 | 0.21 | 0.23 | 1.99 | 0.012 | 0.007 | 0.034 | 0.0058 |
| Comp. Ex. 19 | 0.22 | 0.22 | 0.76 | 0.048 | 0.007 | 0.035 | 0.0055 |
| Comp. Ex. 20 | 0.20 | 0.24 | 0.73 | 0.015 | 0.006 | 0.055 | 0.0054 |
| Comp. Ex. 21 | 0.22 | 0.25 | 0.74 | 0.013 | 0.011 | 0.036 | 0.0280 |
| Comp. Ex. 22 | 0.22 | 0.24 | 0.77 | 0.013 | 0.009 | 0.035 | 0.0520 |
| Comp. Ex. 23 | 0.43 | 0.25 | 0.76 | 0.015 | 0.008 | 0.032 | 0.0050 |
| Comp. Ex. 24 | 0.20 | 0.97 | 0.77 | 0.014 | 0.005 | 0.035 | 0.0053 |
| Comp. Ex. 25 | 0.21 | 0.23 | 1.99 | 0.012 | 0.007 | 0.034 | 0.0058 |
| Comp. Ex. 26 | 0.22 | 0.22 | 0.76 | 0.048 | 0.007 | 0.035 | 0.0055 |
| Comp. Ex. 27 | 0.20 | 0.24 | 0.73 | 0.015 | 0.006 | 0.055 | 0.0054 |
| Comp. Ex. 28 | 0.22 | 0.25 | 0.74 | 0.013 | 0.011 | 0.036 | 0.0280 |
| Comp. Ex. 29 | 0.19 | 0.26 | 0.75 | 0.015 | 0.008 | 0.035 | 0.0055 |
| Comp. Ex. 30 | 0.44 | 0.25 | 0.76 | 0.015 | 0.090 | 0.033 | 0.0058 |
| Comp. Ex. 31 | 0.20 | 0.97 | 0.77 | 0.015 | 0.090 | 0.033 | 0.0058 |
| Comp. Ex. 32 | 0.21 | 0.20 | 1.99 | 0.014 | 0.005 | 0.035 | 0.0053 |
| Comp. Ex. 33 | 0.22 | 0.22 | 0.76 | 0.048 | 0.007 | 0.035 | 0.0055 |
| Comp. Ex. 34 | 0.22 | 0.25 | 0.71 | 0.013 | 0.008 | 0.059 | 0.0056 |
| Comp. Ex. 35 | 0.22 | 0.25 | 0.74 | 0.013 | 0.011 | 0.036 | 0.0280 |
| Comp. Ex. 36 | 0.20 | 0.27 | 0.76 | 0.015 | 0.098 | 0.037 | 0.0049 |
| Comp. Ex. 37 | 0.44 | 0.25 | 0.77 | 0.015 | 0.007 | 0.035 | 0.0053 |
| Comp. Ex. 38 | 0.19 | 0.99 | 0.76 | 0.014 | 0.006 | 0.035 | 0.0054 |

TABLE 7-continued

| Comparative Example No. | C | Si | Mn | P | S | Al | N |
|---|---|---|---|---|---|---|---|
| | | | | mass % | | | |
| Comp. Ex. 39 | 0.21 | 0.24 | 1.94 | 0.012 | 0.008 | 0.031 | 0.0057 |
| Comp. Ex. 40 | 0.21 | 0.25 | 0.73 | 0.046 | 0.010 | 0.034 | 0.0050 |
| Comp. Ex. 41 | 0.23 | 0.24 | 0.77 | 0.013 | 0.008 | 0.055 | 0.0060 |
| Comp. Ex. 42 | 0.21 | 0.24 | 0.76 | 0.015 | 0.010 | 0.035 | 0.0291 |
| Comp. Ex. 43 | 0.22 | 0.26 | 0.77 | 0.013 | 0.006 | 0.033 | 0.0056 |
| Comp. Ex. 44 | 0.19 | 0.26 | 0.75 | 0.015 | 0.008 | 0.035 | 0.0055 |
| Comp. Ex. 45 | 0.44 | 0.25 | 0.76 | 0.015 | 0.090 | 0.033 | 0.0058 |
| Comp. Ex. 46 | 0.21 | 0.93 | 0.73 | 0.014 | 0.007 | 0.037 | 0.0059 |
| Comp. Ex. 47 | 0.21 | 0.27 | 1.98 | 0.012 | 0.008 | 0.034 | 0.0055 |
| Comp. Ex. 48 | 0.20 | 0.25 | 0.76 | 0.048 | 0.010 | 0.038 | 0.0055 |
| Comp. Ex. 49 | 0.22 | 0.24 | 0.77 | 0.013 | 0.008 | 0.059 | 0.0056 |
| Comp. Ex. 50 | 0.21 | 0.26 | 0.75 | 0.015 | 0.004 | 0.033 | 0.0291 |

TABLE 8

| Comparative Example No. | C | Si | Mn | P | S | Al | N |
|---|---|---|---|---|---|---|---|
| | | | | mass % | | | |
| Comp. Ex. 51 | 0.23 | 0.24 | 0.74 | 0.015 | 0.010 | 0.035 | 0.0051 |
| Comp. Ex. 52 | 0.21 | 0.25 | 0.76 | 0.013 | 0.005 | 0.034 | 0.0050 |
| Comp. Ex. 53 | 0.44 | 0.23 | 0.77 | 0.015 | 0.008 | 0.035 | 0.0053 |
| Comp. Ex. 54 | 0.19 | 0.98 | 0.75 | 0.016 | 0.009 | 0.032 | 0.0056 |
| Comp. Ex. 55 | 0.21 | 0.27 | 1.99 | 0.015 | 0.011 | 0.037 | 0.0060 |
| Comp. Ex. 56 | 0.20 | 0.26 | 0.73 | 0.048 | 0.008 | 0.034 | 0.0058 |
| Comp. Ex. 57 | 0.21 | 0.24 | 0.77 | 0.013 | 0.012 | 0.057 | 0.0050 |
| Comp. Ex. 58 | 0.20 | 0.25 | 0.73 | 0.015 | 0.007 | 0.035 | 0.0289 |
| Comp. Ex. 59 | 0.21 | 0.26 | 0.74 | 0.013 | 0.009 | 0.036 | 0.0049 |
| Comp. Ex. 60 | 0.44 | 0.25 | 0.76 | 0.015 | 0.008 | 0.035 | 0.0057 |
| Comp. Ex. 61 | 0.20 | 0.97 | 0.77 | 0.014 | 0.010 | 0.036 | 0.0055 |
| Comp. Ex. 62 | 0.22 | 0.27 | 1.97 | 0.012 | 0.010 | 0.037 | 0.0058 |
| Comp. Ex. 63 | 0.22 | 0.26 | 0.75 | 0.049 | 0.008 | 0.034 | 0.0056 |
| Comp. Ex. 64 | 0.20 | 0.25 | 0.75 | 0.013 | 0.010 | 0.054 | 0.0054 |
| Comp. Ex. 65 | 0.21 | 0.25 | 0.74 | 0.015 | 0.009 | 0.036 | 0.0288 |
| Comp. Ex. 66 | 0.22 | 0.26 | 0.75 | 0.013 | 0.096 | 0.034 | 0.0049 |
| Comp. Ex. 67 | 0.23 | 0.25 | 0.74 | 0.015 | 0.008 | 0.037 | 0.0054 |
| Comp. Ex. 68 | 0.43 | 0.25 | 0.76 | 0.014 | 0.009 | 0.034 | 0.0053 |

TABLE 8-continued

| Comparative Example No. | C | Si | Mn | P | S | Al | N |
|---|---|---|---|---|---|---|---|
| | | | | mass % | | | |
| Comp. Ex. 69 | 0.22 | 0.96 | 0.77 | 0.012 | 0.010 | 0.032 | 0.0056 |
| Comp. Ex. 70 | 0.19 | 0.25 | 1.96 | 0.015 | 0.009 | 0.034 | 0.0059 |
| Comp. Ex. 71 | 0.21 | 0.26 | 0.73 | 0.048 | 0.008 | 0.034 | 0.0052 |
| Comp. Ex. 72 | 0.22 | 0.24 | 0.75 | 0.014 | 0.010 | 0.058 | 0.0055 |
| Comp. Ex. 73 | 0.21 | 0.25 | 0.76 | 0.015 | 0.008 | 0.031 | 0.0290 |
| Comp. Ex. 74 | 0.19 | 0.25 | 0.74 | 0.013 | 0.009 | 0.031 | 0.0050 |

TABLE 8-continued

| Comparative Example No. | C | Si | Mn | P | S | Al | N |
|---|---|---|---|---|---|---|---|
| | | | | mass % | | | |
| Comp. Ex. 75 | 0.18 | 0.26 | 0.76 | 0.015 | 0.008 | 0.034 | 0.0055 |
| Comp. Ex. 76 | 0.21 | 0.26 | 0.74 | 0.013 | 0.010 | 0.033 | 0.0053 |
| Comp. Ex. 77 | 0.20 | 0.26 | 0.76 | 0.015 | 0.099 | 0.034 | 0.0051 |
| Comp. Ex. 78 | 0.20 | 0.25 | 0.76 | 0.015 | 0.008 | 0.035 | 0.0055 |
| Comp. Ex. 79 | 0.20 | 0.25 | 1.97 | 0.015 | 0.007 | 0.034 | 0.0060 |

TABLE 9

| Comparative Example No. | Mo | V | Nb | Cu | Ni | Cr | Sn | Ca | Zr | Pb | Bi | Te | Rem | Sb | Ti | B | W |
|---|---|---|---|---|---|---|---|---|---|---|---|---|---|---|---|---|---|
| | | | | | | | | mass % | | | | | | | | | |
| Comp. Ex. 1 | tr | tr | tr | tr | tr | tr | tr | tr | tr | tr | tr | tr | tr | tr | tr | tr | tr |
| Comp. Ex. 2 | tr | tr | tr | tr | tr | tr | tr | tr | tr | tr | tr | tr | tr | tr | tr | tr | tr |
| Comp. Ex. 3 | tr | tr | tr | tr | tr | tr | tr | tr | tr | tr | tr | tr | tr | tr | tr | tr | tr |
| Comp. Ex. 4 | tr | tr | tr | tr | tr | tr | tr | tr | tr | tr | tr | tr | tr | tr | tr | tr | tr |
| Comp. Ex. 5 | tr | tr | tr | tr | tr | tr | tr | tr | tr | tr | tr | tr | tr | tr | tr | tr | tr |
| Comp. Ex. 6 | tr | tr | tr | tr | tr | tr | tr | tr | tr | tr | tr | tr | tr | tr | tr | tr | tr |
| Comp. Ex. 7 | tr | tr | tr | tr | tr | tr | tr | tr | tr | tr | tr | tr | tr | tr | tr | tr | tr |
| Comp. Ex. 8 | tr | tr | tr | tr | tr | tr | tr | tr | tr | tr | tr | tr | tr | tr | tr | tr | tr |
| Comp. Ex. 9 | tr | tr | tr | tr | tr | tr | tr | tr | tr | tr | tr | tr | tr | tr | tr | tr | tr |
| Comp. Ex. 10 | tr | tr | tr | tr | tr | tr | tr | tr | tr | tr | tr | tr | tr | tr | tr | tr | tr |
| Comp. Ex. 11 | tr | tr | tr | tr | tr | tr | tr | tr | tr | tr | tr | tr | tr | tr | tr | tr | tr |
| Comp. Ex. 12 | tr | tr | tr | tr | tr | tr | tr | tr | tr | tr | tr | tr | tr | tr | tr | tr | tr |
| Comp. Ex. 13 | tr | tr | tr | tr | tr | tr | tr | tr | tr | tr | tr | tr | tr | tr | tr | tr | tr |
| Comp. Ex. 14 | tr | tr | tr | tr | tr | tr | tr | tr | tr | tr | tr | tr | tr | tr | tr | tr | tr |
| Comp. Ex. 15 | tr | tr | tr | tr | tr | tr | tr | tr | tr | tr | tr | tr | tr | tr | tr | tr | tr |
| Comp. Ex. 16 | tr | tr | tr | tr | tr | tr | tr | tr | tr | tr | tr | tr | tr | tr | tr | tr | tr |
| Comp. Ex. 17 | tr | tr | tr | tr | tr | tr | tr | tr | tr | tr | tr | tr | tr | tr | tr | tr | tr |
| Comp. Ex. 18 | tr | tr | tr | tr | tr | tr | tr | tr | tr | tr | tr | tr | tr | tr | tr | tr | tr |
| Comp. Ex. 19 | tr | tr | tr | tr | tr | tr | tr | tr | tr | tr | tr | tr | tr | tr | tr | tr | tr |
| Comp. Ex. 20 | tr | tr | tr | tr | tr | tr | tr | tr | tr | tr | tr | tr | tr | tr | tr | tr | tr |
| Comp. Ex. 21 | tr | tr | tr | tr | tr | tr | tr | tr | tr | tr | tr | tr | tr | tr | tr | tr | tr |
| Comp. Ex. 22 | tr | tr | tr | tr | tr | tr | tr | tr | tr | tr | tr | tr | tr | tr | tr | tr | tr |
| Comp. Ex. 23 | tr | tr | tr | tr | tr | tr | tr | tr | tr | tr | tr | tr | tr | tr | tr | tr | tr |
| Comp. Ex. 24 | tr | tr | tr | tr | tr | tr | tr | tr | tr | tr | tr | tr | tr | tr | tr | tr | tr |
| Comp. Ex. 25 | tr | tr | tr | tr | tr | tr | tr | tr | tr | tr | tr | tr | tr | tr | tr | tr | tr |
| Comp. Ex. 26 | tr | tr | tr | tr | tr | tr | tr | tr | tr | tr | tr | tr | tr | tr | tr | tr | tr |
| Comp. Ex. 27 | tr | tr | tr | tr | tr | tr | tr | tr | tr | tr | tr | tr | tr | tr | tr | tr | tr |
| Comp. Ex. 28 | tr | tr | tr | tr | tr | tr | tr | tr | tr | tr | tr | tr | tr | tr | tr | tr | tr |
| Comp. Ex. 29 | tr | tr | tr | tr | tr | tr | tr | tr | tr | tr | tr | tr | tr | tr | tr | tr | tr |
| Comp. Ex. 30 | tr | tr | tr | tr | tr | tr | tr | tr | tr | tr | tr | tr | tr | tr | tr | tr | tr |
| Comp. Ex. 31 | tr | tr | tr | tr | tr | tr | tr | tr | tr | tr | tr | tr | tr | tr | tr | tr | tr |
| Comp. Ex. 32 | tr | tr | tr | tr | tr | tr | tr | tr | tr | tr | tr | tr | tr | tr | tr | tr | tr |
| Comp. Ex. 33 | tr | tr | tr | tr | tr | tr | tr | tr | tr | tr | tr | tr | tr | tr | tr | tr | tr |
| Comp. Ex. 34 | tr | tr | tr | tr | tr | tr | tr | tr | tr | tr | tr | tr | tr | tr | tr | tr | tr |
| Comp. Ex. 35 | tr | tr | tr | tr | tr | tr | tr | tr | tr | tr | tr | tr | tr | tr | tr | tr | tr |
| Comp. Ex. 36 | tr | tr | tr | tr | tr | tr | tr | tr | tr | tr | tr | tr | tr | tr | tr | tr | tr |
| Comp. Ex. 37 | 1.44 | tr | tr | tr | tr | tr | tr | tr | tr | tr | tr | tr | tr | tr | tr | tr | tr |
| Comp. Ex. 38 | tr | 1.45 | tr | tr | tr | tr | tr | tr | tr | tr | tr | tr | tr | tr | tr | tr | tr |
| Comp. Ex. 39 | tr | tr | tr | tr | tr | tr | tr | tr | tr | tr | tr | tr | tr | tr | tr | tr | tr |
| Comp. Ex. 40 | tr | tr | tr | 0.98 | 0.95 | tr | tr | tr | tr | tr | tr | tr | tr | tr | tr | tr | tr |
| Comp. Ex. 41 | tr | tr | tr | tr | 2.43 | tr | tr | tr | tr | tr | tr | tr | tr | tr | tr | tr | tr |
| Comp. Ex. 42 | tr | tr | tr | tr | tr | 1.95 | tr | tr | tr | tr | tr | tr | tr | tr | tr | tr | tr |
| Comp. Ex. 43 | tr | tr | tr | tr | tr | tr | 0.07 | tr | tr | tr | tr | tr | tr | tr | tr | tr | tr |
| Comp. Ex. 44 | tr | tr | tr | tr | tr | tr | tr | tr | tr | tr | tr | tr | tr | tr | tr | tr | tr |
| Comp. Ex. 45 | tr | tr | tr | tr | tr | tr | tr | tr | 0.076 | tr | tr | tr | tr | tr | tr | tr | tr |
| Comp. Ex. 46 | tr | tr | tr | tr | tr | tr | tr | tr | tr | 0.39 | tr | tr | tr | tr | tr | tr | tr |
| Comp. Ex. 47 | tr | tr | tr | tr | tr | tr | tr | tr | tr | tr | 0.28 | tr | tr | tr | tr | tr | tr |
| Comp. Ex. 48 | tr | tr | tr | tr | tr | tr | tr | tr | tr | tr | tr | 0.29 | tr | tr | tr | tr | tr |
| Comp. Ex. 49 | tr | tr | tr | tr | tr | tr | tr | tr | tr | tr | tr | tr | 0.099 | tr | tr | tr | tr |
| Comp. Ex. 50 | tr | tr | tr | tr | tr | tr | tr | tr | tr | tr | tr | tr | tr | 0.096 | tr | tr | tr |

TABLE 10

| Comparative Example No. | Mo | V | Nb | Cu | Ni | Cr | Sn | Ca | Zr | Pb | Bi | Te | Rem | Sb | Ti | B | W |
|---|---|---|---|---|---|---|---|---|---|---|---|---|---|---|---|---|---|
| | | | | | | | | mass % | | | | | | | | | |
| Comp. Ex. 51 | tr | tr | tr | tr | tr | tr | tr | 0.0087 | tr | tr | tr | tr | tr | tr | tr | tr | tr |
| Comp. Ex. 52 | tr | tr | tr | tr | tr | tr | tr | tr | tr | tr | tr | tr | tr | tr | tr | tr | tr |
| Comp. Ex. 53 | tr | tr | tr | tr | tr | tr | tr | tr | tr | tr | tr | tr | tr | tr | tr | tr | tr |
| Comp. Ex. 54 | tr | tr | tr | tr | tr | tr | tr | tr | tr | tr | 0.29 | tr | tr | tr | tr | tr | tr |
| Comp. Ex. 55 | tr | tr | tr | tr | tr | tr | tr | tr | tr | tr | tr | 0.29 | tr | tr | tr | tr | tr |

TABLE 10-continued

| Comparative Example No. | Mo | V | Nb | Cu | Ni | Cr | Sn | Ca | Zr | Pb | Bi | Te | Rem | Sb | Ti | B | W |
|---|---|---|---|---|---|---|---|---|---|---|---|---|---|---|---|---|---|
| | | | | | | | | mass % | | | | | | | | | |
| Comp. Ex. 56 | tr | tr | tr | tr | tr | tr | tr | tr | tr | tr | tr | tr | tr | tr | tr | tr | tr |
| Comp. Ex. 57 | tr | tr | tr | tr | tr | tr | tr | tr | tr | tr | tr | tr | 0.098 | tr | tr | tr | tr |
| Comp. Ex. 58 | tr | tr | tr | tr | tr | tr | tr | tr | tr | tr | tr | tr | tr | 0.097 | tr | tr | tr |
| Comp. Ex. 59 | tr | tr | tr | tr | tr | tr | tr | 0.0086 | tr | tr | tr | tr | tr | tr | tr | tr | tr |
| Comp. Ex. 60 | tr | tr | tr | tr | tr | tr | tr | tr | 0.077 | tr | tr | tr | tr | tr | tr | tr | tr |
| Comp. Ex. 61 | tr | tr | tr | tr | tr | tr | tr | tr | tr | 0.37 | tr | tr | tr | tr | tr | tr | tr |
| Comp. Ex. 62 | tr | tr | tr | tr | tr | tr | tr | tr | tr | tr | 0.29 | tr | tr | tr | tr | tr | tr |
| Comp. Ex. 63 | tr | tr | tr | tr | tr | tr | tr | tr | tr | tr | tr | 0.29 | tr | tr | tr | tr | tr |
| Comp. Ex. 64 | tr | tr | tr | tr | tr | tr | tr | tr | tr | tr | tr | tr | 0.098 | tr | tr | tr | tr |
| Comp. Ex. 65 | tr | tr | tr | tr | tr | tr | tr | tr | tr | tr | tr | tr | tr | 0.095 | tr | tr | tr |
| Comp. Ex. 66 | tr | tr | tr | tr | tr | tr | tr | 0.0088 | tr | tr | tr | tr | tr | tr | tr | tr | tr |
| Comp. Ex. 67 | 1.47 | tr | tr | tr | tr | tr | tr | tr | 0.081 | tr | tr | tr | tr | tr | tr | tr | tr |
| Comp. Ex. 68 | tr | 1.48 | tr | tr | tr | tr | tr | tr | tr | 0.37 | tr | tr | tr | tr | tr | tr | tr |
| Comp. Ex. 69 | tr | tr | 1.49 | tr | tr | tr | tr | tr | tr | tr | 0.28 | tr | tr | tr | tr | tr | tr |
| Comp. Ex. 70 | tr | tr | tr | 0.98 | 0.95 | tr | tr | tr | tr | tr | tr | 0.29 | tr | tr | tr | tr | tr |
| Comp. Ex. 71 | tr | tr | tr | tr | 2.45 | tr | tr | tr | tr | tr | tr | tr | 0.097 | tr | tr | tr | tr |
| Comp. Ex. 72 | tr | tr | tr | tr | tr | 1.94 | tr | tr | tr | tr | tr | tr | tr | 0.097 | tr | tr | tr |
| Comp. Ex. 73 | tr | tr | tr | tr | tr | tr | 0.09 | tr | tr | 0.38 | tr | tr | tr | tr | tr | tr | tr |
| Comp. Ex. 74 | tr | tr | tr | tr | tr | tr | tr | tr | tr | tr | tr | tr | tr | tr | 0.003 | 0.0003 | tr |
| Comp. Ex. 75 | tr | tr | tr | tr | tr | tr | tr | tr | tr | tr | tr | tr | tr | tr | 0.283 | 0.0047 | tr |
| Comp. Ex. 76 | tr | tr | tr | tr | tr | tr | tr | tr | tr | tr | tr | tr | tr | tr | 0.013 | 0.0021 | tr |
| Comp. Ex. 77 | tr | tr | tr | tr | tr | tr | tr | tr | tr | tr | tr | tr | tr | tr | 0.007 | 0.0002 | tr |
| Comp. Ex. 78 | tr | tr | tr | tr | tr | tr | tr | 0.0090 | tr | tr | tr | tr | tr | tr | 0.023 | 0.0022 | tr |
| Comp. Ex. 79 | tr | tr | tr | 0.99 | 0.97 | tr | tr | tr | tr | tr | tr | 0.29 | tr | tr | 0.017 | 0.0033 | tr |

TABLE 11

| Comparative Example No. | Rc % | Cmin, 1 — | Cmin, 2 — | L/F — | L/S — | Maximum bending amount (Bar-shaped test piece) μm | Maximum roundness value (Ring-shaped test piece) μm |
|---|---|---|---|---|---|---|---|
| Comp. Ex. 1 | 33.3 | 0.94 | 0.91 | 0.52 | 0.55 | 24.3 | — |
| Comp. Ex. 2 | 27.8 | 0.93 | 0.92 | 0.51 | 0.56 | 23.1 | — |
| Comp. Ex. 3 | 24.3 | 0.91 | 0.93 | 0.48 | 0.58 | 20.1 | — |
| Comp. Ex. 4 | 37.8 | 0.90 | 0.91 | 0.42 | 0.55 | 29.9 | — |
| Comp. Ex. 5 | 27.8 | 0.93 | 0.92 | 0.55 | 0.52 | 20.4 | — |
| Comp. Ex. 6 | 35.2 | 0.95 | 0.92 | 0.46 | 0.54 | 22.2 | — |
| Comp. Ex. 7 | 29.8 | 0.88 | 0.93 | 0.54 | 0.54 | 25.3 | — |
| Comp. Ex. 8 | 35.7 | 0.94 | 0.88 | 0.52 | 0.57 | — | 15.6 |
| Comp. Ex. 9 | 33.2 | 0.93 | 0.92 | 0.50 | 0.56 | — | 16.1 |
| Comp. Ex. 10 | 36.8 | 0.89 | 0.82 | 0.44 | 0.52 | — | 20.1 |
| Comp. Ex. 11 | 34.2 | 0.90 | 0.84 | 0.48 | 0.50 | — | 21.1 |
| Comp. Ex. 12 | 37.8 | 0.92 | 0.91 | 0.57 | 0.53 | — | 16.0 |
| Comp. Ex. 13 | 40.1 | 0.93 | 0.90 | 0.56 | 0.50 | — | 19.4 |
| Comp. Ex. 14 | 37.1 | 0.94 | 0.85 | 0.53 | 0.52 | — | 19.3 |
| Comp. Ex. 15 | 34.9 | 0.90 | 0.91 | 0.69 | 0.58 | 23.5 | — |
| Comp. Ex. 16 | 21.3 | 0.85 | 0.91 | 0.55 | 0.52 | 27.3 | — |
| Comp. Ex. 17 | 21.1 | 0.94 | 0.93 | 0.59 | 0.49 | 21.1 | — |
| Comp. Ex. 18 | 31.8 | 0.82 | 0.91 | 0.66 | 0.59 | 28.3 | — |
| Comp. Ex. 19 | 27.8 | 0.89 | 0.93 | 0.46 | 0.48 | 22.6 | — |
| Comp. Ex. 20 | 31.3 | 0.96 | 0.92 | 0.54 | 0.50 | 21.0 | — |
| Comp. Ex. 21 | 31.9 | 0.91 | 0.93 | 0.59 | 0.48 | 24.0 | — |
| Comp. Ex. 22 | 34.9 | 0.90 | 0.89 | 0.55 | 0.52 | 23.8 | 17.1 |
| Comp. Ex. 23 | 21.3 | 0.85 | 0.91 | 0.56 | 0.53 | 26.2 | 17.5 |
| Comp. Ex. 24 | 21.1 | 0.94 | 0.92 | 0.58 | 0.51 | 20.1 | 18.8 |
| Comp. Ex. 25 | 36.0 | 0.95 | 0.84 | 0.55 | 0.64 | 28.0 | 17.7 |
| Comp. Ex. 26 | 27.8 | 0.89 | 0.90 | 0.52 | 0.48 | 22.5 | 17.5 |
| Comp. Ex. 27 | 32.1 | 0.96 | 0.83 | 0.54 | 0.50 | 20.8 | 24.4 |
| Comp. Ex. 28 | 31.9 | 0.91 | 0.91 | 0.54 | 0.59 | 23.8 | 15.9 |
| Comp. Ex. 29 | 33.3 | 0.91 | 0.89 | 0.57 | 0.52 | 24.0 | 18.6 |
| Comp. Ex. 30 | 35.7 | 0.90 | 0.91 | 0.56 | 0.52 | 26.2 | 17.5 |
| Comp. Ex. 31 | 38.2 | 0.93 | 0.92 | 0.58 | 0.51 | 20.1 | 18.8 |
| Comp. Ex. 32 | 41.1 | 0.89 | 0.84 | 0.57 | 0.62 | 28.0 | 17.7 |
| Comp. Ex. 33 | 42.0 | 0.92 | 0.90 | 0.54 | 0.48 | 22.5 | 17.5 |
| Comp. Ex. 34 | 33.5 | 0.92 | 0.83 | 0.55 | 0.50 | 20.8 | 24.4 |
| Comp. Ex. 35 | 31.2 | 0.93 | 0.91 | 0.57 | 0.57 | 23.8 | 15.9 |
| Comp. Ex. 36 | 29.8 | 0.94 | 0.92 | 0.59 | 0.55 | 20.5 | — |
| Comp. Ex. 37 | 32.7 | 0.93 | 0.86 | 0.49 | 0.44 | — | 24.3 |
| Comp. Ex. 38 | 35.8 | 0.96 | 0.91 | 0.45 | 0.46 | 30.7 | — |
| Comp. Ex. 39 | 32.1 | 0.95 | 0.90 | 0.48 | 0.61 | 20.0 | 19.8 |
| Comp. Ex. 40 | 24.3 | 0.92 | 0.90 | 0.54 | 0.50 | 23.5 | — |

TABLE 11-continued

| Comparative Example No. | Rc % | Cmin, 1 — | Cmin, 2 — | L/F — | L/S — | Maximum bending amount (Bar-shaped test piece) μm | Maximum roundness value (Ring-shaped test piece) μm |
|---|---|---|---|---|---|---|---|
| Comp. Ex. 41 | 33.2 | 0.96 | 0.86 | 0.48 | 0.45 | 32.4 | 22.5 |
| Comp. Ex. 42 | 37.8 | 0.96 | 0.89 | 0.40 | 0.54 | 33.3 | — |
| Comp. Ex. 43 | 20.1 | 0.90 | 0.92 | 0.58 | 0.58 | 22.1 | 15.5 |
| Comp. Ex. 44 | 21.1 | 0.88 | 0.93 | 0.57 | 0.52 | 21.0 | — |
| Comp. Ex. 45 | 32.5 | 0.95 | 0.94 | 0.51 | 0.45 | 23.0 | — |
| Comp. Ex. 46 | 33.3 | 0.91 | 0.92 | 0.79 | 0.57 | 24.8 | — |
| Comp. Ex. 47 | 24.3 | 0.90 | 0.90 | 0.44 | 0.32 | 26.8 | — |
| Comp. Ex. 48 | 25.6 | 0.90 | 0.93 | 0.59 | 0.55 | 21.5 | — |
| Comp. Ex. 49 | 35.4 | 0.96 | 0.92 | 0.55 | 0.50 | 26.2 | — |
| Comp. Ex. 50 | 22.8 | 0.82 | 0.90 | 0.47 | 0.58 | 27.6 | — |

TABLE 12

| Comparative Example No. | Rc % | Cmin, 1 — | Cmin, 2 — | L/F — | L/S — | Maximum bending amount (Bar-shaped test piece) μm | Maximum roundness value (Ring-shaped test piece) μm |
|---|---|---|---|---|---|---|---|
| Comp. Ex. 51 | 34.4 | 0.93 | 0.93 | 0.56 | 0.55 | — | 15.8 |
| Comp. Ex. 52 | 38.2 | 0.92 | 0.88 | 0.53 | 0.51 | — | 20.3 |
| Comp. Ex. 53 | 38.9 | 0.94 | 0.82 | 0.55 | 0.52 | — | 17.3 |
| Comp. Ex. 54 | 42.7 | 0.92 | 0.92 | 0.55 | 0.55 | — | 16.8 |
| Comp. Ex. 55 | 45.1 | 0.89 | 0.90 | 0.54 | 0.56 | — | 16.4 |
| Comp. Ex. 56 | 40.9 | 0.91 | 0.86 | 0.51 | 0.50 | — | 19.8 |
| Comp. Ex. 57 | 37.4 | 0.90 | 0.89 | 0.52 | 0.49 | — | 18.8 |
| Comp. Ex. 58 | 35.4 | 0.92 | 0.85 | 0.56 | 0.57 | — | 15.8 |
| Comp. Ex. 59 | 29.8 | 0.90 | 0.93 | 0.46 | 0.51 | 23.1 | — |
| Comp. Ex. 60 | 36.6 | 0.92 | 0.91 | 0.52 | 0.48 | — | 15.3 |
| Comp. Ex. 61 | 35.8 | 0.96 | 0.88 | 0.64 | 0.57 | 20.2 | 18.1 |
| Comp. Ex. 62 | 31.9 | 0.95 | 0.82 | 0.53 | 0.52 | 21.9 | 21.9 |
| Comp. Ex. 63 | 25.0 | 0.93 | 0.87 | 0.65 | 0.59 | 20.1 | 16.1 |
| Comp. Ex. 64 | 27.8 | 0.92 | 0.82 | 0.50 | 0.50 | 21.3 | 22.6 |
| Comp. Ex. 65 | 38.4 | 0.93 | 0.92 | 0.55 | 0.55 | — | 16.4 |
| Comp. Ex. 66 | 33.2 | 0.90 | 0.92 | 0.52 | 0.49 | 25.7 | — |
| Comp. Ex. 67 | 33.0 | 0.96 | 0.94 | 0.49 | 0.50 | 21.0 | — |
| Comp. Ex. 68 | 32.6 | 0.92 | 0.90 | 0.55 | 0.52 | — | 17.5 |
| Comp. Ex. 69 | 22.3 | 0.91 | 0.91 | 0.57 | 0.53 | 21.4 | — |
| Comp. Ex. 70 | 30.4 | 0.89 | 0.88 | 0.52 | 0.52 | 20.3 | 20.1 |
| Comp. Ex. 71 | 38.0 | 0.91 | 0.91 | 0.53 | 0.54 | — | 17.6 |
| Comp. Ex. 72 | 31.2 | 0.92 | 0.90 | 0.59 | 0.58 | 20.0 | 21.2 |
| Comp. Ex. 73 | 28.0 | 0.84 | 0.92 | 0.45 | 0.42 | 35.3 | — |
| Comp. Ex. 74 | 34.3 | 0.92 | 0.93 | 0.50 | 0.51 | 24.5 | — |
| Comp. Ex. 75 | 36.9 | 0.93 | 0.80 | 0.51 | 0.49 | — | 21.2 |
| Comp. Ex. 76 | 22.3 | 0.84 | 0.90 | 0.54 | 0.53 | 26.2 | 16.8 |
| Comp. Ex. 77 | 31.8 | 0.91 | 0.91 | 0.53 | 0.51 | 23.7 | — |
| Comp. Ex. 78 | 24.8 | 0.90 | 0.94 | 0.47 | 0.44 | 23.6 | — |
| Comp. Ex. 79 | 37.0 | 0.92 | 0.89 | 0.52 | 0.51 | 20.4 | 22.2 |

Industrial Applicability

As described above, according to the present invention, it is possible to provide the case hardened steel product having reduced thermal treatment distortion caused through the quenching processes using carburizing and nitriding, having improved dimensional accuracy, and exhibiting excellent fatigue characteristics. Thus, the present invention is highly applicable in the industry where mechanical components are manufactured.

Brief Description of the Reference Symbols

L: distance (mm) from the center of a cross section of steel to a position closest to the center of the cross section of the steel and located on the periphery of the equiaxed zone in the macrostructure in the cross section of the steel.

F: distance (mm) from the center of a cross section of steel to a position located on the periphery of the equiaxed zone and in a direction opposed, with respect to the center of the cross section, to the position closest to the center of the cross section and located on the periphery of the equiaxed zone in the macrostructure in the cross section of the steel.

S: larger distance (mm) from among distances from the center of the cross section of steel to positions at which the periphery of the equiaxed zone crosses a line passing through the center of the cross section of all lines perpendicular to a line connecting the center in the cross section and the position closest to the center of the cross section and located on the periphery of the equiaxed zone in the macrostructure in the cross section of the steel.

The invention claimed is:

1. A case hardened steel having a cross section having a macrostructure including an equiaxed zone and a columnar zone disposed around the equiaxed zone, the case hardened steel having a composition comprising, in mass %:

C: 0.05 to 0.45%;
Si: 0.01 to .0%;
Mn: more than 0 to 2.0%;
Al: 0.001 to 0.06%;
N: 0.002 to 0.03%;
S: more than 0 to 0.1%;
P: more than 0 to 0.05%; and
balance: Fe and inevitable impurities, wherein
Equation (1) described below and Equation (2) described below are satisfied in the equiaxed zone, or
Equation (3) described below is satisfied in the columnar zone, $$Re=(Ae/Ao)\times 100\leq 30\% \quad \text{Equation (1)}$$

$$(Cmin,\ 1/Co)\geq 0.95 \quad \text{Equation (2)}$$

$$(Cmin,\ 2/Co)\geq 0.95 \quad \text{Equation (3)}$$

where,

Re: area fraction (%) of the equiaxed zone,
Ae: area of the equiaxed zone,
Ao: area of the cross section,
Co: average concentration (mass %) of C in the cross section, or concentration (mass %) of C in molten steel in a ladle or continuous casting tundish,
Cmin, 1: minimum concentration (mass %) of C in the equiaxed zone, and
Cmin, 2: minimum concentration (mass %) of C in the columnar zone.

2. The case hardened steel according to claim 1, wherein Equation (1) and Equation (2) are satisfied in the equiaxed zone, and
Equation (3) is satisfied in the columnar zone.

3. The case hardened steel according to claim 1, wherein at least one of Equation (4) described below and Equation (5) described below is satisfied in the equiaxed zone, $$(L/F)\geq 0.6 \quad \text{Equation (4)}$$

$$(L/S)\geq 0.6 \quad \text{Equation (5)}$$

where,

L: distance (mm) from a center of the cross section to a position closest to the center of the cross section and located on the periphery of the equiaxed zone,
F: distance (mm) from the center of the cross section to a position located on the periphery of the equiaxed zone and in a direction opposed, with respect to the center of the cross section, to the position closest to the center of the cross section and located on the periphery of the equiaxed zone, and
S: larger distance (mm) from among distances from the center of the cross section to positions at which the periphery of the equiaxed zone crosses a line passing through the center of the cross section of all lines perpendicular to a line connecting the center of the cross section and a position closest to the center of the cross section and located on the periphery of the equiaxed zone.

4. The case hardened steel according to claim 3, wherein Equation (4) and Equation (5) are satisfied in the equiaxed zone.

5. The case hardened steel according to 1, wherein the composition of the steel further comprises at least one of, in mass %:

Mo: more than 0 to 1.5%;
V: more than 0 to 1.5%;
Nb: more than 0 to 1.5%;
Cu: more than 0 to 1.0%;
Ni: more than 0 to 2.5%;
Cr: more than 0 to 2.0%;
Sn: more than 0 to 1.0%;
Ca: more than 0 to 0.01%;
Zr: more than 0 to 0.08%;
Pb: more than 0 to 0.4%;
Bi: more than 0 to 0.3%;
Te: more than 0 to 0.3%;
Rem: more than 0 to 0.1%;
Sb: more than 0 to 0.1%;
Ti: more than 0 to 0.30%;
B: more than 0 to 0.005%; and
W: more than 0 to 2.0%.

6. The case hardened steel according to claim 2, wherein at least one of Equation (4) described below and Equation (5) described below is satisfied in the equiaxed zone, $$(L/F)\geq 0.6 \quad \text{Equation (4)}$$

$$(L/S)\geq 0.6 \quad \text{Equation (5)}$$

where,

L: distance (mm) from a center of the cross section to a position closest to the center of the cross section and located on the periphery of the equiaxed zone,
F: distance (mm) from the center of the cross section to a position located on the periphery of the equiaxed zone and in a direction opposed, with respect to the center of the cross section, to the position closest to the center of the cross section and located on the periphery of the equiaxed zone, and
S: larger distance (mm) from among distances from the center of the cross section to positions at which the periphery of the equiaxed zone crosses a line passing through the center of the cross section of all lines perpendicular to a line connecting the center of the cross section and a position closest to the center of the cross section and located on the periphery of the equiaxed zone.

7. The case hardened steel according to claim 6, wherein Equation (4) and Equation (5) are satisfied in the equiaxed zone.

8. A mechanical component obtained by machining the case hardened steel according to claim 1, and applying a thermal treatment to the machined case hardened steel.

9. A mechanical component obtained by machining the case hardened steel according to claim 2, and applying a thermal treatment to the machined case hardened steel.

10. A mechanical component obtained by machining the case hardened steel according to claim 3, and applying a thermal treatment to the machined case hardened steel.

11. A mechanical component obtained by machining the case hardened steel according to claim 4, and applying a thermal treatment to the machined case hardened steel.

12. A mechanical component obtained by machining the case hardened steel according to claim 5, and applying a thermal treatment to the machined case hardened steel.

13. A mechanical component obtained by machining the case hardened steel according to claim 6, and applying a thermal treatment to the machined case hardened steel.

14. A mechanical component obtained by machining the case hardened steel according to claim 7, and applying a thermal treatment to the machined case hardened steel.

* * * * *